US005147770A

United States Patent [19]

Waki et al.

[11] Patent Number: 5,147,770

[45] Date of Patent: Sep. 15, 1992

[54] ENTITLED SILVER HALIDE PHOTOGRAPHIC MATERIALS

[75] Inventors: Kokichi Waki; Shigeru Ohno, both of Kanagawa, Japan

[73] Assignee: Fuji Photo Film Co., Ltd., Kanagawa, Japan

[21] Appl. No.: 814,858

[22] Filed: Dec. 30, 1991

Related U.S. Application Data

[63] Continuation of Ser. No. 385,962, Jul. 28, 1989, abandoned, which is a continuation of Ser. No. 79,073, Jul. 29, 1987, abandoned.

[30] Foreign Application Priority Data

Jul. 29, 1986 [JP] Japan ..... 61-178444

[51] Int. Cl.[5] ..... G03C 1/06; G03C 7/26

[52] U.S. Cl. ..... 430/522; 430/550; 430/567

[58] Field of Search ..... 430/522, 595, 567, 550, 430/507

[56] References Cited

U.S. PATENT DOCUMENTS

| | | | |
|---|---|---|---|
| 3,865,817 | 2/1975 | Kobayashi et al. | 430/522 |
| 4,221,863 | 9/1980 | Overman et al. | 430/567 |
| 4,284,717 | 8/1981 | Toya et al. | 430/567 |
| 4,500,631 | 2/1985 | Sakamoto et al. | 430/522 |
| 4,640,889 | 2/1987 | Komorita et al. | 430/567 |
| 4,755,455 | 7/1988 | Iwasa | 430/567 |
| 4,830,956 | 5/1989 | Waki | 430/567 |
| 4,892,812 | 1/1990 | Kohmura et al. | 430/522 |

FOREIGN PATENT DOCUMENTS

| | | |
|---|---|---|
| 59-29243 | 2/1984 | Japan . |
| 60-225142 | 11/1985 | Japan . |
| 225154 | 11/1985 | Japan . |
| 60-225154 | 11/1985 | Japan . |
| 0248043 | 11/1986 | Japan . |
| 2178551 | 2/1987 | United Kingdom . |

*Primary Examiner*—Richard L. Schilling
*Attorney, Agent, or Firm*—Sughrue, Mion, Zinn, Macpeak & Seas

[57] ABSTRACT

A silver halide color photographic material is disclosed. The photographic material comprises a support having provided thereon at least one silver halide emulsion layer wherein silver halide grains comprise monodisperse silver chlorobromide containing at least 2 mol % of silver chloride and having an area ratio of crystal face of Mirror indeces (100) satisfying the relationship:

$$5.0 \leqq K \leqq \infty$$

wherein K represents the ratio of the intensity of diffracted rays attributable to (200) face to that of diffracted rays attributable to (222) face determined by X-ray diffraction analytical method, represented by:

$$K = \frac{\text{Intensity of diffracted rays attributable to (200) face}}{\text{Intensity of diffracted rays attributable to (222) face}}$$

and wherein said silver halide color photographic material contains at least one dye represented by the formula (II):

wherein n, $R^1$, $R^2$, $R^3$, $R^4$ and L are as defined above.

8 Claims, No Drawings

ENTITLED SILVER HALIDE PHOTOGRAPHIC MATERIALS

This is a continuation of application Ser. No. 07/385,962 filed Jul. 28, 1989, now abandoned, which was a continuation of application Ser. No. 07/079,073, filed Jul. 29, 1987 now abandoned.

FIELD OF THE INVENTION

The present invention relates to a silver halide color photographic material. More particularly, the present invention relates to a silver halide color photographic material which provides improvements in the dependence of photographic sensitivity on moisture at exposure and the color reproduction while maintaining excellent image sharpness.

BACKGROUND OF THE INVENTION

In general, a silver halide color photographic material employs the three color separation process. Each silver halide layer is subjected to spectral sensitization with respective sensitizing dye. A blue-sensitive silver halide emulsion layer contains a yellow color coupler, a green-sensitive silver halide emulsion layer contains a magenta color coupler, and a red-sensitive silver halide emulsion layer contains a cyan color coupler. After being imagewise exposed to light, the light-sensitive material is processed with a color developing solution containing a p-phenylenediamine derivative as a color developing agent, and then subjected to blix to provide a color image. In order to improve the color reproduction of such a color image, it is very important to prevent the sensitivity of each silver halide emulsion layer from being affected by heat or moisture upon the imagewise exposure to light. On the other hand, studies have been made on irradiation dyes, anti-irradiation dyes, supports, and layer construction to improve the sharpness of the color image. In particular, dyes, which exert a great effect on the sharpness, have been intensively studied.

In order to select dyes suitably, some characteristics such as spectral absorption and decolorization and elution properties upon development were used as measures. Oxonol dyes, azo dyes, and anthraquinone dyes have been studied in the hope that they can satisfy these requirements. Excellent among these dyes are oxonol dyes. Examples of such dyes are disclosed in Japanese Patent Publication Nos. 13168/68, 1419/76, 28085/78, 10060/80, 10061/80, 10187/80 and 10899/80, Japanese Patent Application (OPI) Nos. 145125/75 and 33104/80 (the term "OPI" as used herein means an unexamined published patent application), U.S. Pat. No. 3,647,460, and British Patent No. 1,338,799.

In the silver halide color photographic material, if the crystalline phases of the silver halide emulsion are uniformed so that a monodispersion is provided, the density of the color image can be increased, making it possible to save the amount of silver to be coated. Furthermore, if a combination of one or more silver halide emulsions is used, an excellent gradation can be obtained, improving the color reproduction. However, a silver halide emulsion containing many (100) faces has some disadvantages. While such a silver halide emulsion can easily adsorb a spectral sensitizer, maintaining a suitable spectral sensitivity for color reproduction, and shows a small change in the sensitivity during the storage of unprocessed photographic materials for a long period of time, it causes a sensitivity drop due to effects other than optical absorption effect if the above mentioned dyes are used, and further causes a bigger sensitivity drop if the humidity upon exposure becomes high. Such a sensitivity drop greatly impedes the color reproduction. On the other hand, in order to improve the sharpness of the color image, it is desired that the maximum spectral absorption of the dye is consistent with that of each silver halide emulsion layer. However, the oxonol dyes which provide an improved spectral sensitivity still cause a sensitivity drop.

Oxonol dyes excellent in decolorization and elution properties upon development are disclosed in Japanese Patent Publication Nos. 22069/64, 3504/68, 46607/76 and 10059/80, Japanese Patent Application (OPI) No. 225155/85, and U.S. Pat. No. 4,564,590. However, there are no reference to important characteristics of sensitivity for color reproduction. Furthermore, the characteristics of silver halide emulsions to be combined are not made clear.

SUMMARY OF THE INVENTION

It is therefore an object of the present invention to provide a silver halide color photographic material which is subject to less sensitivity drop and a low dependence on moisture at exposure and can provide an excellent color reproduction by combining a monodisperse silver chlorobromide emulsion having particles whose (100) plane satisfies the relationship $5.5 \leqq K \leqq \infty$ (wherein K is as defined later) and containing at least 2 mol % of silver chloride, together with a dye which gives no adverse effect to the silver halide emulsion having the (100) face.

The above and other objects of the present invention will be apparent from the following detailed description and examples.

A silver halide emulsion having a K value extremely smaller than 5 cannot sufficiently adsorb a spectral sensitizer. Such a silver halide emulsion cannot provide a sufficient spectral sensitivity or shows a poor fresh preservability. On the contrary, if the silver chloride content is less than 2 mol %, it is difficult to prepare a silver halide emulsion having a K value of 5 or more.

These objects of the present invention are accomplished by a silver halide color photographic material which comprises a support having provided thereon at least one silver halide emulsion layer wherein silver halide grains comprise monodisperse silver chlorobromide containing at least 2 mol % of silver chloride and having an area ratio of crystal face of a Mirror indices (100) satisfying the relationship (I):

$$5.0 \leqq K \leqq \infty$$

wherein K represents the ratio of the intensity of diffracted rays attributable to (200) face to that of diffracted rays attributable to (222) face determined by X-ray diffraction analytical method, represented by:

$$K = \frac{\text{Intensity of diffracted rays attributable to (200) face}}{\text{Intensity of diffracted rays attributable to (222) face}}$$

and wherein said silver halide color photographic material contains at least one dye represented by the formula (II):

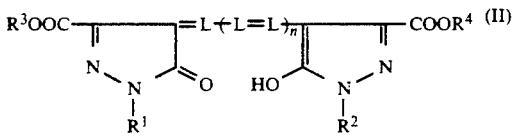

(II)

wherein n represents 0, 1 or 2; $R^1$ and $R^2$ each represents an alkyl group containing at least one sulfonic acid group or carboxylic acid group; an aryl group containing at least one sulfonic acid group or carboxylic group; or a heterocyclic group containing at least one sulfonic acid group or carboxylic acid group; $R^3$ and $R^4$ each represents a hydrogen atom, a substituted or unsubstituted alkyl group or a substituted or unsubstituted aryl group when n represents 0 or 1, or a hydrogen atom, a substituted alkyl group containing at least one sulfonic acid group or carboxylic acid group or a substituted aryl group containing at least one sulfonic acid group or a carboxylic acid group when n represents 2; and L represents a substituted or unsubstituted methine group, and any two or more of the substituents on L may be linked together to form a ring.

DETAILED DESCRIPTION OF THE INVENTION

In the formula (II), the alkyl group containing at least one sulfonic acid group or carboxylic group represented by $R^1$ and $R^2$ preferably represents an alkyl group having 1 to 6 carbon atoms. Examples of such alkyl groups include sulfomethyl group, carboxymethyl group, 2-carboxyethyl group, 2-sulfoethyl group, 3-sulfopropyl group, 3-sulfo-2,2-dimethylpropyl group, 4-sulfobutyl group, 4-carboxybutyl group, 3-carboxypropyl group, 2-methyl-3-sulfopropyl group, 5-sulfopentyl group, 6-sulfohexyl group, etc. The alkyl group may be further substituted with groups containing atoms such as oxygen and sulfur or phenyl groups. Examples of substituted alkyl groups include 2-(2-sulfoethoxy)ethyl group, 3-(2-carboxyethylthio)propyl group, 2-(3 -sulfopropyloxy)ethyl group, and 2-(4-sulfophenyl)ethyl group.

In the formula (II), the aryl group containing at least one sulfonic acid group or carboxylic acid group represented by $R^1$ and $R^2$ preferably represents a phenyl group. Examples of such phenyl groups include 4-sulfophenyl group, 3-sulfophenyl group, 2-sulfophenyl group, 4-(3-sulfopropylcarbamoyl)phenyl group, 2,4-disulfophenyl group, 3,5-disulfophenyl group, 3-(3-sulfopropylamino)phenyl group, 3,5-dicarboxyphenyl group, 4-carboxyphenyl group, 3-carboxy-5-sulfophenyl group, etc. The aryl group may be further substituted with halogen atoms such as a chlorine atom and a bromine atom or a substituent such as hydroxyl group, methoxy group, ethoxy group, methyl group, and ethyl group.

In the formula (II), examples of the heterocyclic group containing at least one sulfonic acid group or carboxylic acid group represented by $R^1$ and $R^2$ include 2-(5-sulfo)benzimidazolyl group, 2-(6-sulfo)benzthiazolyl group, 2-(6-sulfo)benzoxazolyl group, and 2-(5-carboxy)benzimidazolyl group, etc.

The groups $R^1$ and $R^2$ in the formula (II) is preferably an alkyl group containing at least one sulfonic acid group or carboxylic acid group from the standpoint of excellent color reproduction and image sharpness.

In the formula (II), the substituted or unsubstituted alkyl group represented by $R^3$ and $R^4$ preferably represents a lower alkyl group. Examples of lower alkyl group include methyl group, ethyl group, 2-hydroxyethyl group, 2-cyanoethyl group, n-propyl group, 2-carboxyethyl group, 2-sulfoethyl group, 3-sulfopropyl group, isopropyl group, 3-carboxypropyl group, n-butyl group, t-butyl group, n-hexyl group, n-pentyl group, t-amyl group, 4-sulfobutyl group, 5-sulfopentyl group, benzyl group, and 2-(2-hydroxyethoxy)ethyl group.

In the formula (II), examples of the substituted or unsubstituted aryl group of $R^3$ or $R^4$ include phenyl group, 2,4-di-t-amylphenyl group, 4-methylphenyl group, 4-(2-sulfoethoxy)phenyl group, 4-sulfophenyl group, 3,5-disulfophenyl group, 2,4-disulfophenyl group, 2-methyl-4-sulfophenyl group, 2-chloro-4-sulfophenyl group, 4-carboxyphenyl group, 4-methoxyphenyl group, 4-(3-sulfopropylcarbamoyl)phenyl group, 4-(N-ethyl-N-4-sulfobutylamino)phenyl group, 3,6-disulfo-α-naphthyl group, and 6,8-disulfo-α-naphthyl group.

In the formula (II), the substituent on the methine group of L preferably represents an alkyl group having 1 to 4 carbon atoms such as methyl group, ethyl group, 3-hydroxypropyl group, 2-sulfoethyl group, carboxymethyl group, and hydroxymethyl group, an aryl group such as phenyl group, 4-chlorophenyl group, and 4-sulfophenyl group, or a halogen atom such as chlorine atom and bromine atom. These substituents may be linked together to form a ring such as 4,4-dimethyl-1-cyclohexene ring and coumaline ring.

In the formula (II), the sulfonic acid group or carboxylic acid as substituent may form a salt such as sodium salt, potassium salt, ammonium salt, and quaternary ammonium salt as well as a free acid.

Specific examples of typical dyes of the formula (II) are shown below, but the present invention is not limited thereto.

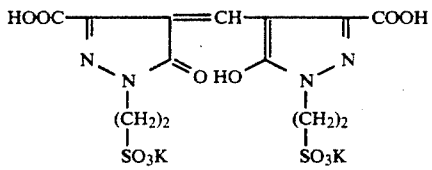

1.

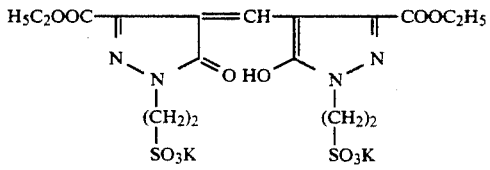

2.

-continued
3.
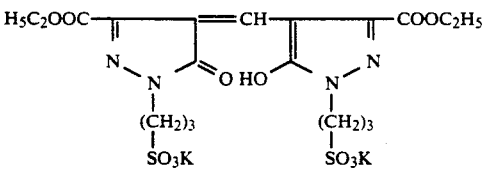
4.
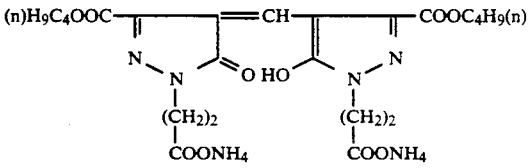
5.
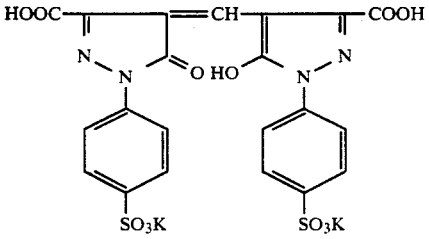
6.
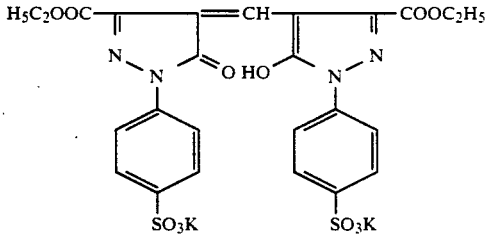
7.
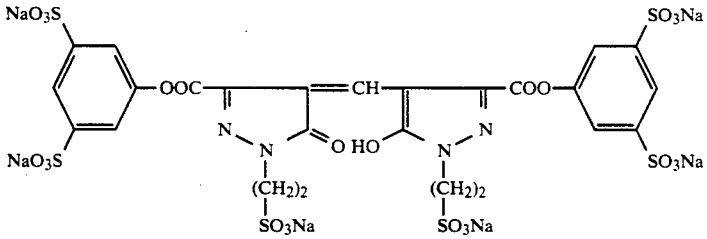
8.
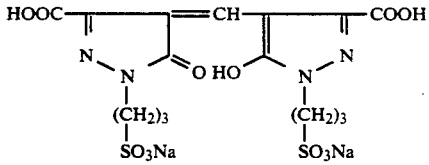
9.
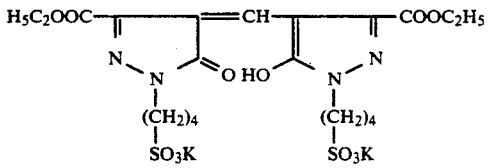

-continued
10.
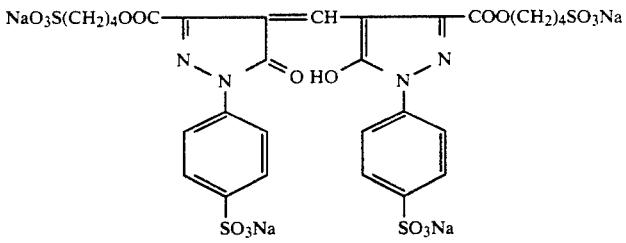
11.
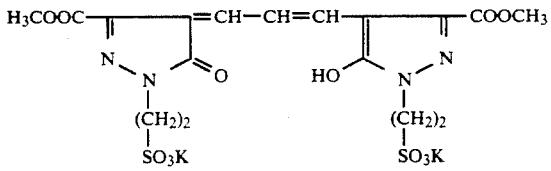
12.
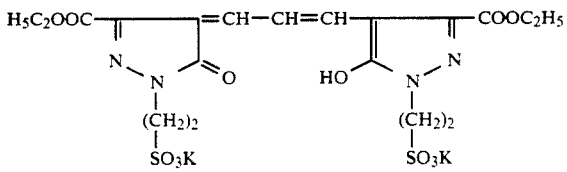
13.
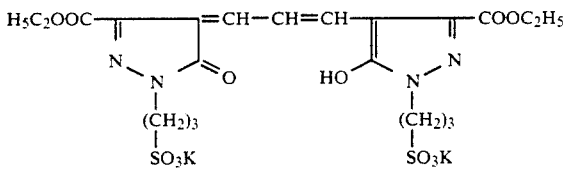
14.
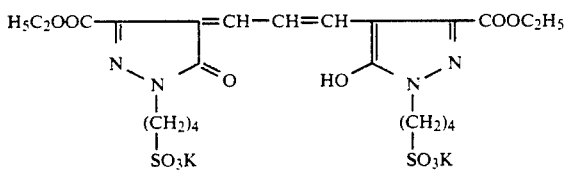
15.
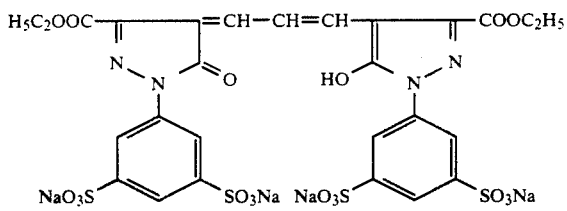
16.
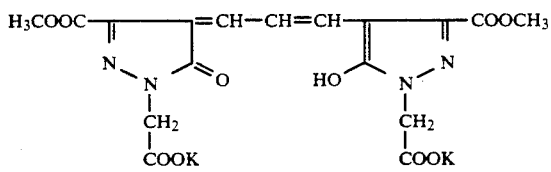
17.
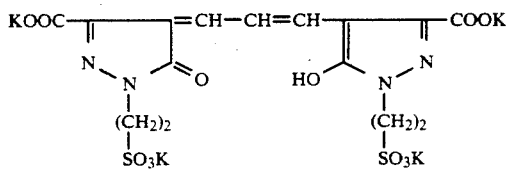

-continued
18.
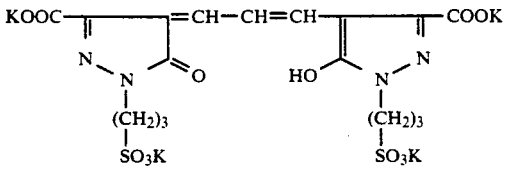
19.
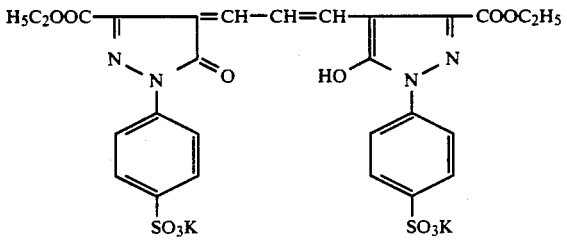
20.
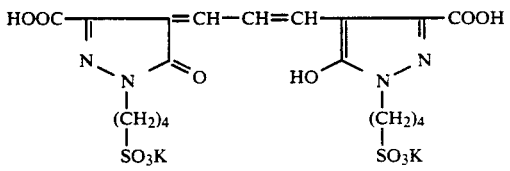
21.
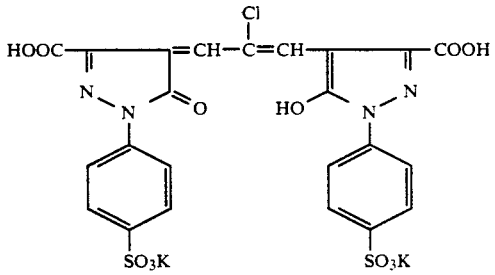
22.
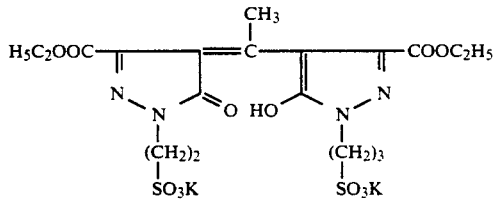
23.
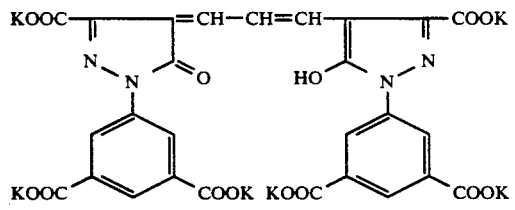
24.
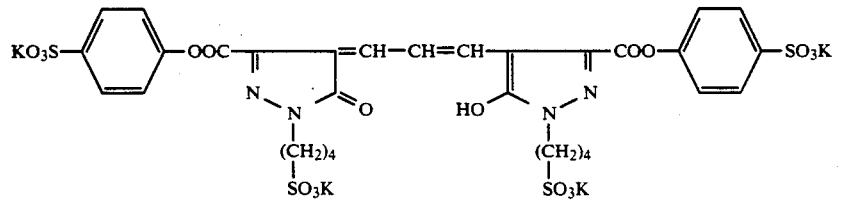

-continued
25.
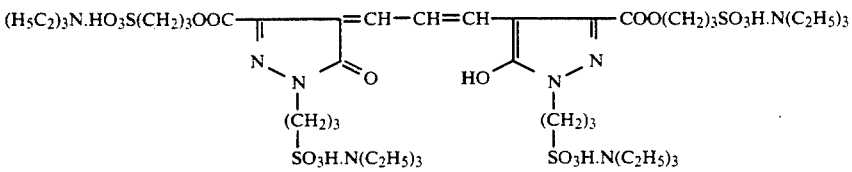
26.
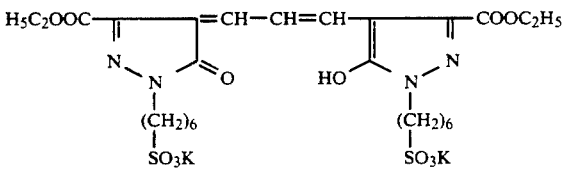
27.
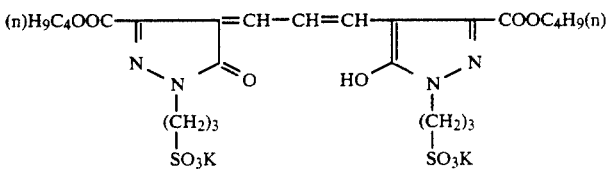
28.
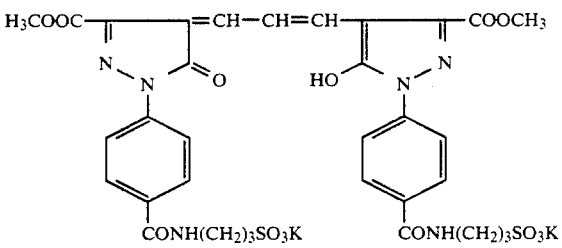
29.
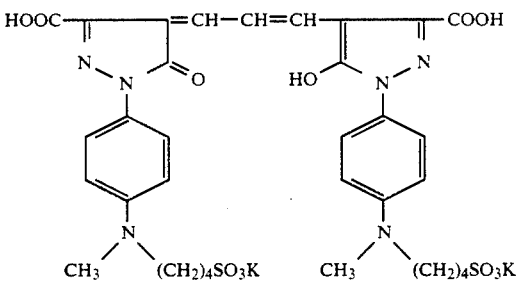
30.
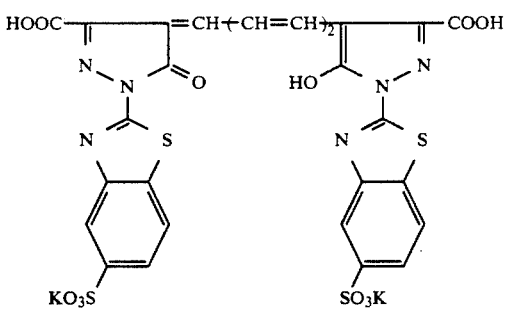
31.
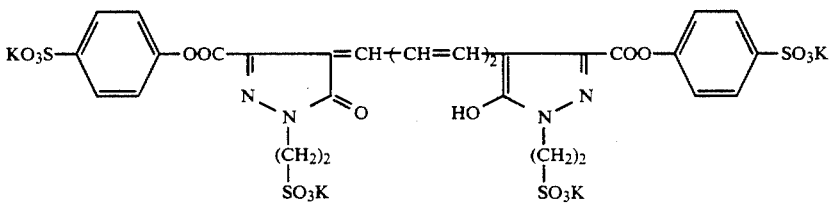

-continued
32.
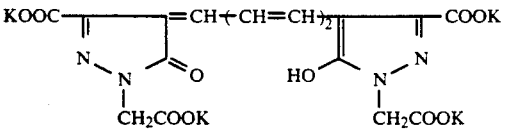
33.
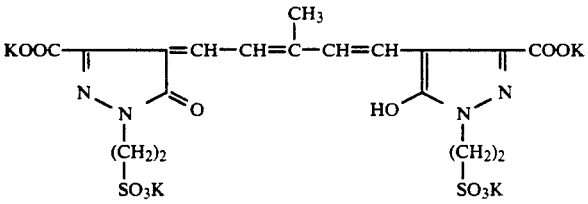
34.
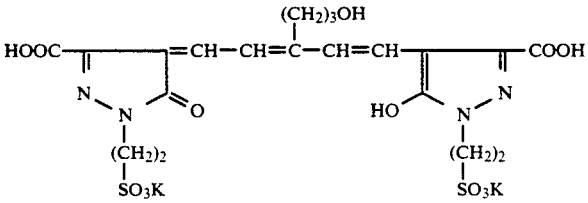
35.
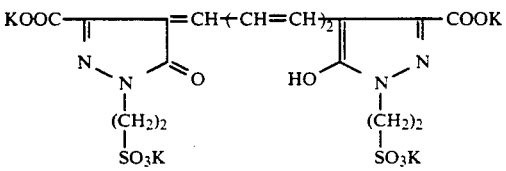
36.
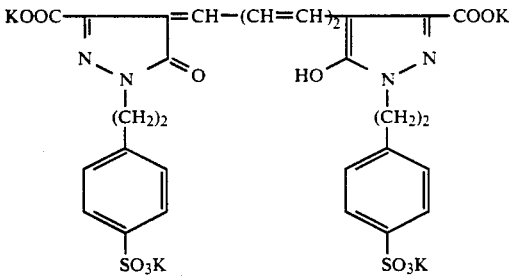
37.
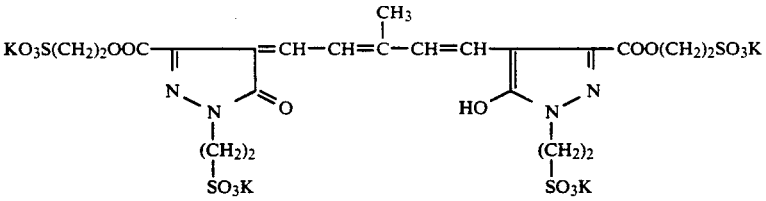
38.
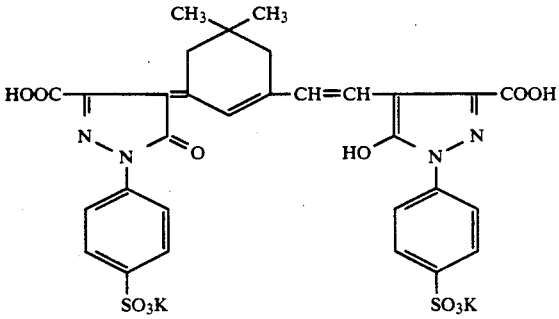

-continued
39.
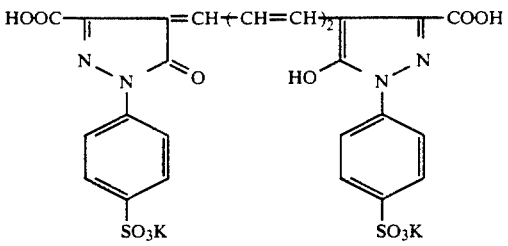
40.
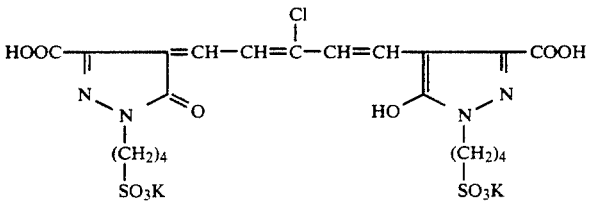
41.
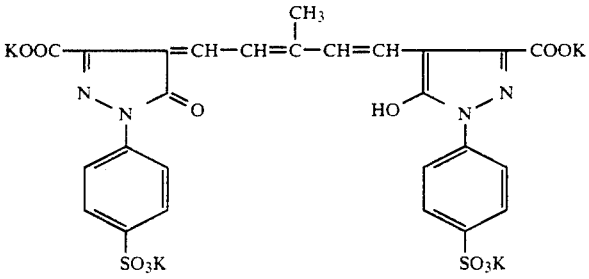
42.
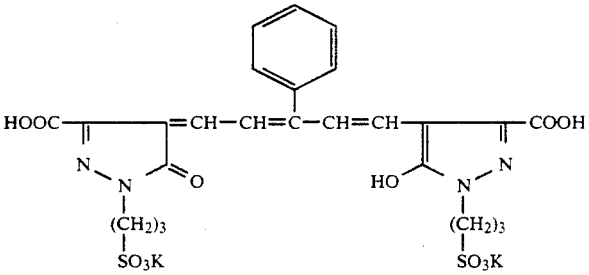
43.
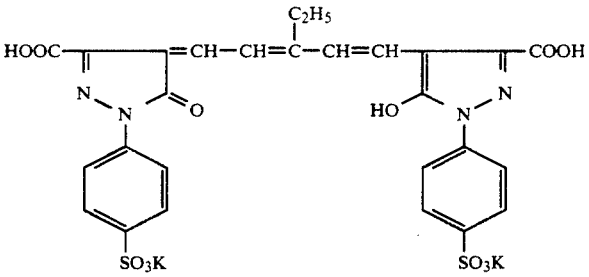
44.
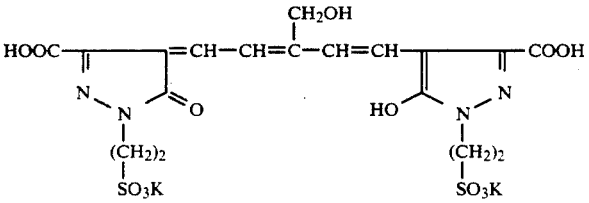

-continued
45.
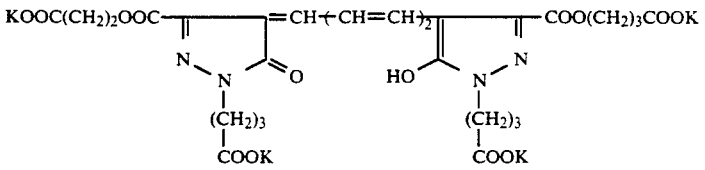
46.
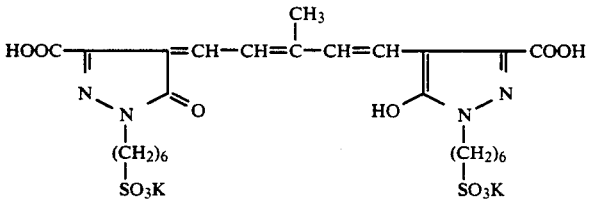
47.
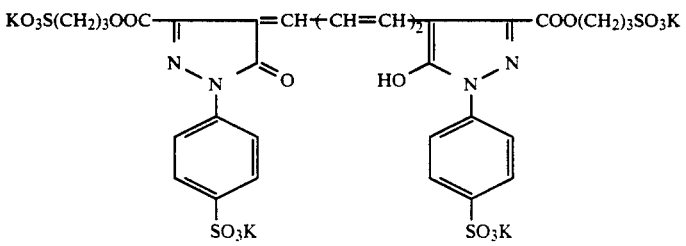
48.
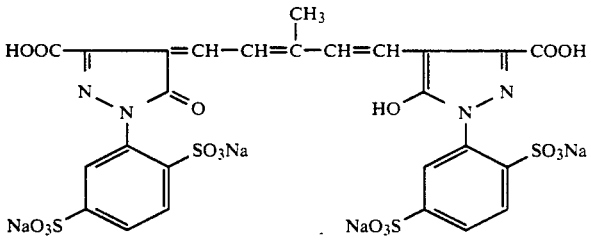
49.
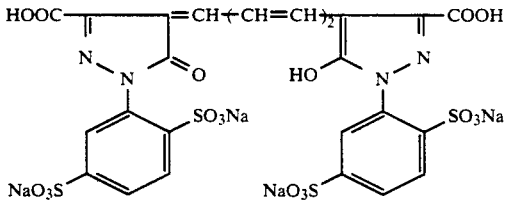
50.
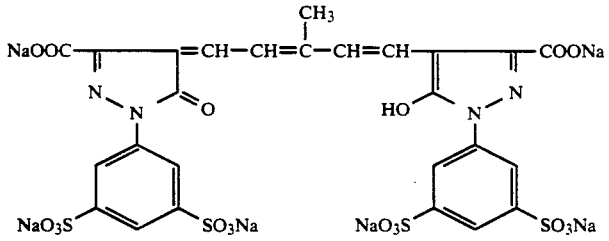
51.
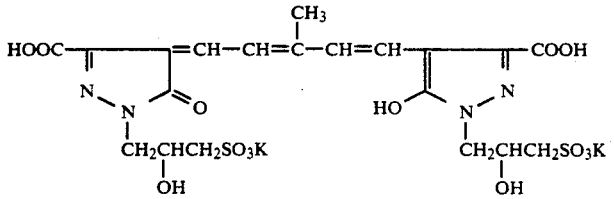

-continued
52.
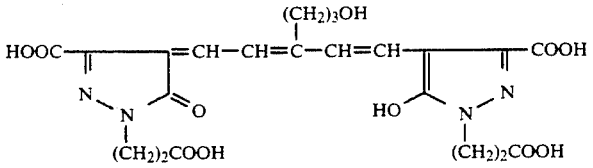
53.
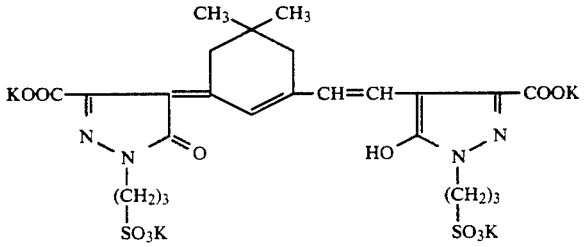
54.
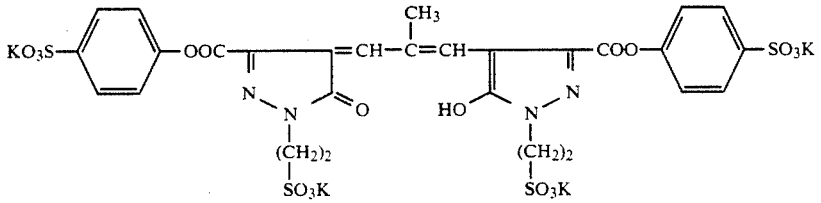
55.
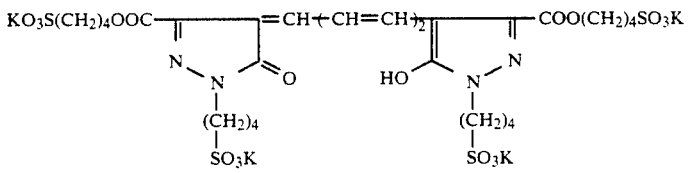
56.
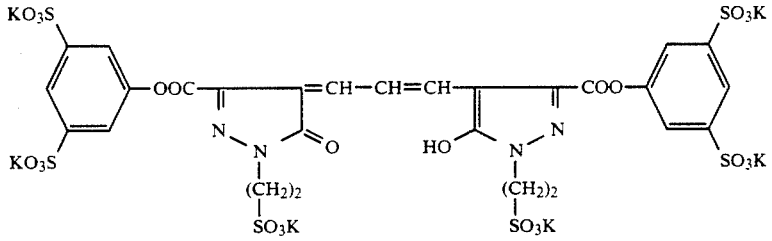
57.
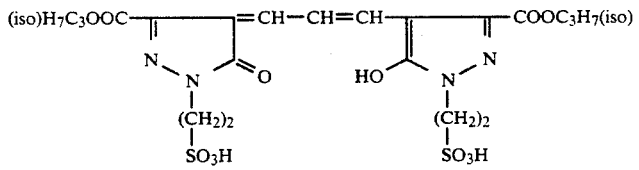
58.
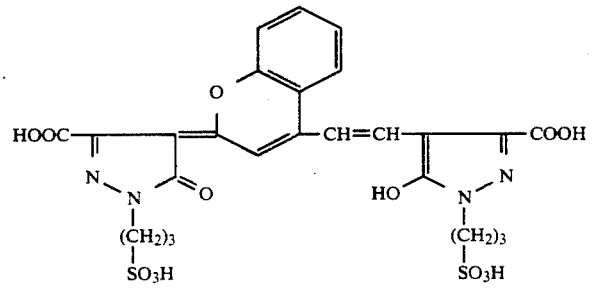

-continued
59.
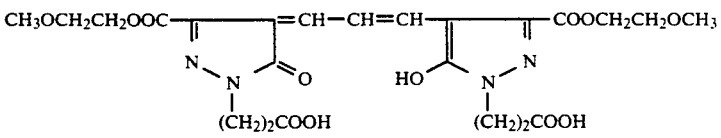
60.
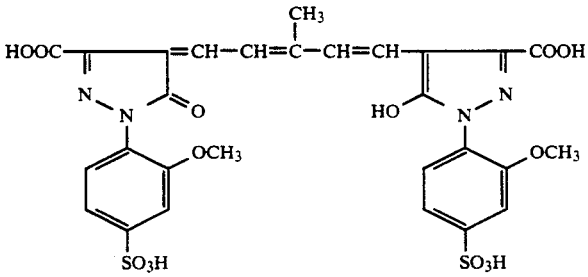
61.
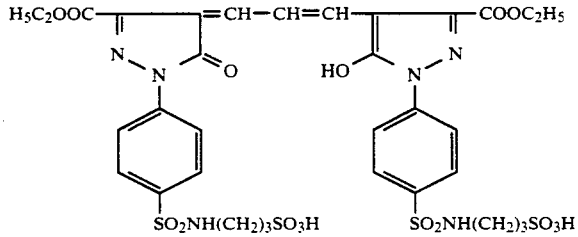
62.
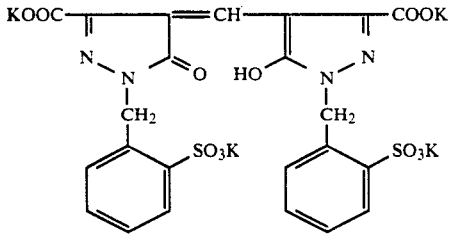
63.
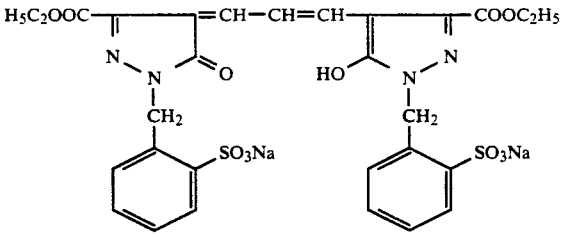
64.
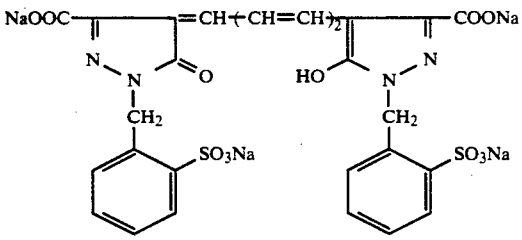

-continued
65.
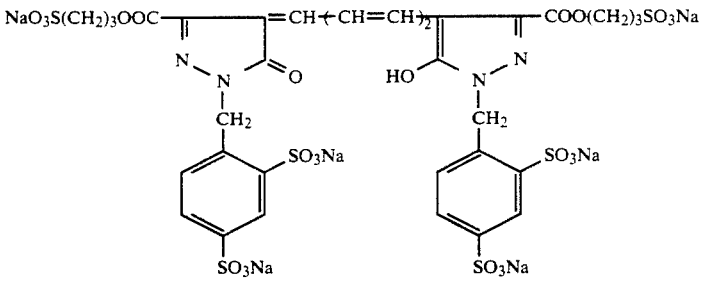
66.
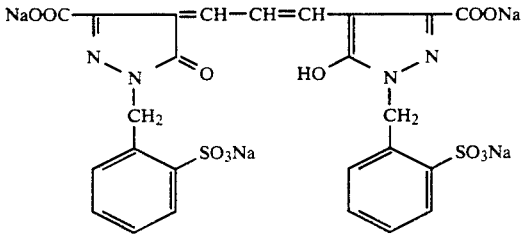
67.
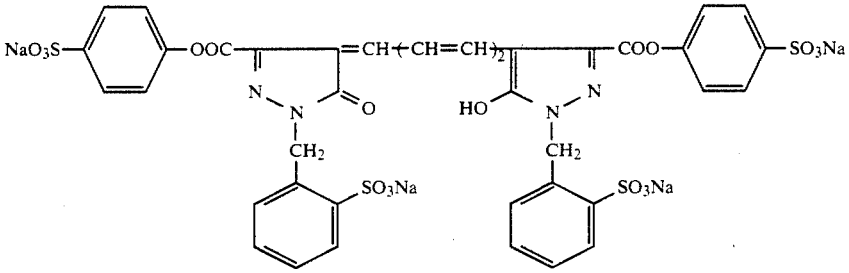
68.
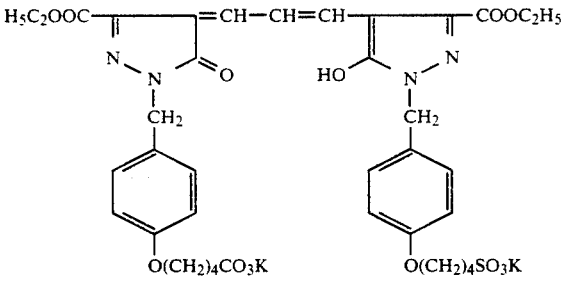
69.
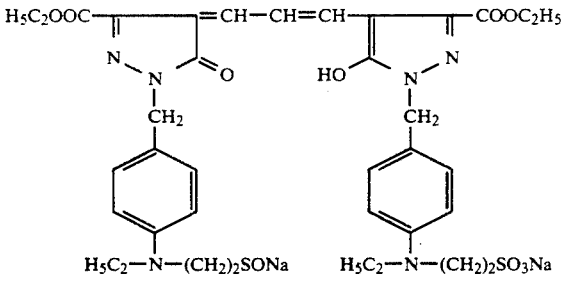
70.
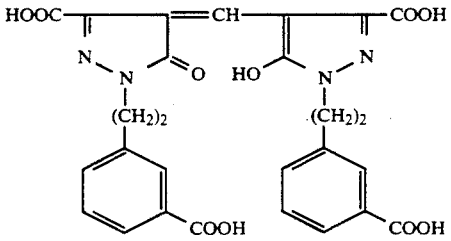

-continued

71.

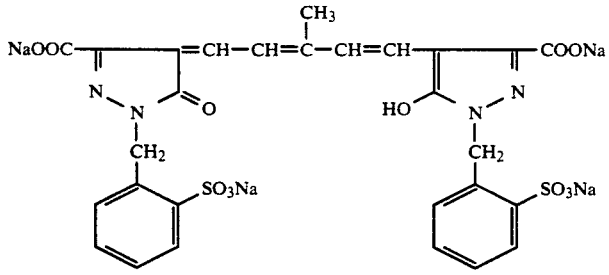

72.

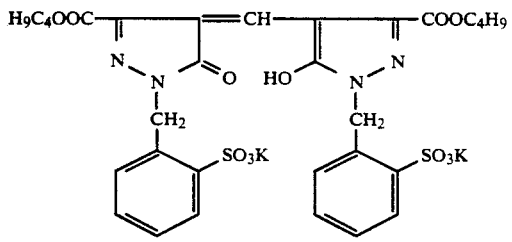

73.

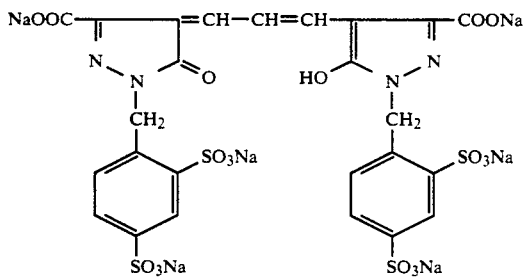

The synthesis of the dye used in the present invention can be accomplished by any suitable conventional method as described in Japanese Patent Publication Nos. 22069/64, 3504/68, 38056/77, 38129/79 and 10059/80, Japanese Patent Application (OPI) No. 16834/84, and U.S. Pat. No. 4,187,225.

The dye used in the present invention can be incorporated into the non-light-sensitive layer and/or light-sensitive layer of the silver halide color photographic material. Two or more of the dyes may be used in combination.

The coating amount of the dye is not specifically limited, but is preferably $1\times10^{-6}$ to $2\times10^{-3}$ mol/m$^2$.

The K value of the monodisperse silver halide grains used in the present invention generally satisfies the relationship $5.0\leqq K\leqq\infty$, preferably $10.0\leqq K\leqq\infty$, and more preferably $20.0\leqq K\leqq\infty$.

The determination of the silver halide grains used in the present invention is defined by diffraction pattern obtained by the X-ray diffraction analytical method of silver halide grains coated and oriented on a substrate, as described in *Bulletin of the Scientific Photography of Japan* (Vol. 13, pp. 5-15, 1963). In this respect, Cu-K$\alpha$ rays are used as X-ray sources. The intensity of diffracted rays attributable to (200) face which corresponds to (100) face, and to (222) face which corresponds to the (111) face, of the silver halide grains are measured at the diffraction angle $2\theta$ of about 30.9° and about 55.0°, respectively. The area ratio of (100) face to (111) face is determined by the ratio between the two intensities of diffracted rays. For instance, when the above ratio between the two intensities of diffracted rays is represented by the following equation for the perfect cubic grain and the perfect octahedron grain:

$$K = \frac{\text{Intensity of diffracted rays attributable to (200) face}}{\text{Intensity of diffracted rays attributable to (222) face}}$$

the perfect cubic grain particle has $K=\infty$, while the perfect octahedron grain has $K=0$.

The monodisperse silver halide grain preferably has an average size of 0.1 to 2 $\mu$m, particularly 0.2 to 1,3 $\mu$m, in terms of diameter of circle equivalent thereto by projected area. The particle size distribution representing the degree of monodispersion is preferably 0.2 or less, more preferably 0.15 or less, in terms of the ratio ($S/\bar{d}$) of the statistical standard deviation S to the average particle size $\bar{d}$.

The monodisperse silver halide grains used in the present invention comprise silver chlorobromide containing at least 2 mol %, preferably 10 mol % or more, more preferably 90 mol % or more of silver chloride. The silver halide may be substantially free of silver iodide or, if any, contain 0.5 mol % or less of silver iodide.

If the content of silver chloride is 90 mol % or more, the effect of the dye is relatively reduced, further improving the dependence of photographic sensitivity on moisture at exposure and color reproducibility.

The monodisperse silver halide grains used in the present invention may have a structure where the inner layer and the surface layer have different phases, a multiphase structure having a fused structure, or a homogeneous structure. The silver halide grains may consist of such various phases in combination.

The monodisperse silver halide grains used in the present invention may be of the surface latent image type in which a latent image is formed mainly on the surface thereof or of the internal latent image type in which a latent image is formed mainly in the internal portion thereof.

The preparation of the silver halide emulsion used in the present invention can be accomplished by any suitable method as described in *Chimie et Physique Photographique* (edited by P. Glafkides, published by Paul Montel, 1967), and *Making and Coating Photographic Emulsion* (edited by V. L. Zelikman et al, published by Focal Press, 1964). That is, any one of acid process, neutral process, and ammonia process can be used. The reaction of a soluble silver salt with a soluble halogen salt can be accomplished by one-side mixing process, simultaneous mixing process, or a combination thereof. A process in which particles are formed in excess silver ions (so-called reverse mixing process) can be used. One form of the reverse mixing process is a so-called controlled double jet process in which the pAg of the liquid phase in which silver halide is formed is kept constant. By this process, silver halide grains having a regular crystal shape and a nearly uniform size can be obtained.

Examples of silver halides which can be used include silver halide prepared by a so-called conversion process comprising a process in which silver halide which has been formed is converted to silver halide having a smaller solubility product before or after the formation of silver halide grains is completed.

In the process for the formation of silver halide grains or the physical ripening thereof, a cadmium salt, zinc salt, copper salt, lead salt, thallium salt, iridium salt or complex salt thereof, rhodium salt or complex salt thereof, or iron salt or complex salt thereof may be present.

Any suitable silver halide solvent such as ammonia, potassium thiocyanate, and thioether or thione compound as described in U.S. Pat. No. 3,271,157, and Japanese Patent Application (OPI) Nos. 12360/76, 82408/78, 144319/78, 100717/79 and 155828/79 can be used in the process of physical or chemical ripening.

In general, the silver halide emulsion of the present invention is subjected to physical ripening, desalting, and chemical ripening after the formation of grains before being used for coating. The removal of the water-soluble salt from the emulsion which has been subjected to physical ripening can be accomplished by noodle washing, flocculation sedimentation process, or ultrafiltration process.

The silver halide emulsion used in the present invention can be subjected to a sulfur sensitization using a sulfur-containing compound which can react with active gelatin or silver (e.g., thiosulfates, thioureas, mercapto compounds, and rhodanines), reduction sensitization using a reducing substance (e.g., stannous salt, amines, hydrazine derivatives, formamidinesulfinic acid, and silane compounds), or noble metal sensitization using a metal compound (e.g., gold complex salt, and metal complex salt of Group VIII of the Periodic Table such as Pt, Ir, Pd, Rh, and Fe), alone or in combination.

In order to satisfy the gradation required by the silver halide color photographic material of this invention, two or more monodisperse silver halide emulsions having different particle size (preferably having the above described deviation coefficient to exhibit monodispersibility) can be coated on the same layer or separately coated on separate layers in emulsion layers having substantially the same color sensitivity.

The blue-sensitive, green-sensitive and red-sensitive emulsions are emulsions which have been respectively subjected to spectral sensitization with a methine dye or the like so as to be rendered color-sensitive. Examples of such a methine dye include cyanine dye, merocyanine dye, composite cyanine dye, composite merocyanine dye, holopolar cyanine dye, hemicyanine dye, styryl dye, and hemioxonol dye. Particularly useful among these dyes are cyanine dye, merocyanine dye, and composite merocyanine dye. Any nucleus commonly used for cyanine dyes can be applied to these dyes as basic heterocyclic nucleus. Examples of such nucleus include pyrroline nucleus, oxazoline nucleus, thiazoline nueleus, thiazole nucleus, selenazole nucleus, imidazole nucleus, tetrazole nucleus, pyridine nucleus, these nuclei to which alicyclic hydrocarbon rings are fused, and these nuclei to which aromatic hydrocarbon rings are fused, such as indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, and quinoline nucleus. These nuclei may have substituent(s) on carbon atom(s) thereof.

Examples of nucleus having a ketomethylene structure which can be applied to the merocyanine dye or composite merocyanine dye include 5- or 6-membered heterocyclic nucleus such as pyrazoline-5-one nucleus, thiohydantoine nucleus, 2-thioxazolidine-2,4-dione nucleus, thiazolidine-2,4-dione nucleus, rhodanine nucleus, and thiobarbituric acid nucleus.

These sensitizing dyes may be used alone or in combination. Combinations of these sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, and Japanese Patent Application (OPI) Nos. 110618/77 and 109925/77.

The emulsion of the present invention may contain a dye which itself exhibits no spectral sensitivity or a substance which substantially absorbs no visible light but exhibits a supersensitivity, together with the above sensitizing dye.

The color coupler to be incorporated in the silver halide color photographic material is preferably rendered fast to diffusion by containing ballast groups or being polymerized. The amount of silver to be coated can be more saved by using a two-equivalent color coupler substituted with a coupling-off group than a four-equivalent color coupler containing a hydrogen atom in the coupling activity position. Examples of other color couplers which can be used in the present invention include couplers which form a dye having a proper diffusibility, colorless couplers, DIR couplers which release a development inhibitor upon coupling reaction, and couplers which release a development accelerator upon coupling reaction.

A typical example of a yellow coupler which can be used in the present invention is an oil protect type acylacetamide coupler. Specific examples of such an oil protect type acylacetamide coupler are described in U.S. Pat. Nos. 2,407,210, 2,875,057 and 3,265,506. In the present invention, two-equivalent yellow couplers are preferably used. Typical examples of such two-equivalent yellow couplers include oxygen atom-releasing type yellow couplers as described in U.S. Pat. Nos. 3,408,194, 3,477,928, 3,933,501 and 4,022,620, and nitrogen atom-releasing type yellow couplers as described in Japanese Patent Publication No. 10739/83, U.S. Pat. Nos. 4,401,752 and 4,326,024, *Research Disclosure* No. 18053 (April 1979), British Patent 1,425,020, and West German Patent Application (OLS) Nos. 2,219,917, 2,261,361, 2,329,587 and 2,433,812. α-Pivaloylacetanilide couplers are excellent in fastness of color forming dye, especially to light. On the other hand, α-benzoylacetanilide couplers can provide a high color density.

Examples of magenta couplers which can be used in the present invention include oil protect type indazolone or cyanoacetyl, preferably 5-pyrazolone or pyrazoloazole couplers such as pyrazolotriazoles. 5-Pyrazolone couplers which are substituted with arylamino groups or acylamino groups in the 3-position can be preferably used in the light of hue of color forming dye or color density. Typical examples of such couplers are described in U.S. Pat. Nos. 2,311,082, 2,343,703, 2,600,788, 2,908,573, 3,062,653, 3,152,896 and 3,936,015. Examples of suitable coupling-off groups for the two-equivalent 5-pyrazolone coupler include nitrogen atom-releasing groups as described in U.S. Pat. No. 4,310,619, and arylthio groups as described in U.S. Pat. No. 4,351,897. 5-Pyrazolone couplers containing ballast groups as described in European Patent 73,636 can provide a high color density.

As the pyrazoloazole coupler, pyrazolobenzimidazoles as described in U.S. Pat. No. 3,369,879 can be used. Preferred examples of such a pyrazoloazole coupler include pyrazolo[5,1-c][1,2,4]triazoles as described in U.S. Pat. No. 3,725,067, pyrazolotetrazoles as described in *Research Disclosure* No. 24220 (June, 1984), and pyrazolopyrazoles as described in *Research Disclosure* No. 24230 (June, 1984). Imidazo[1,2-b]pyrazoles as described in European Patent 119,741 can be preferably used because they can produce a color forming dye having less auxiliary yellow absorption and excellent fastness to light. Pyrazolo[1,5-b][1,2,4] as described in European Patent 119,860 is particularly preferred.

Examples of cyan couplers which can be used in the present invention include oil protect type naphthol or phenol couplers. Typical examples of such naphthol couplers include those described in U.S. Pat. No. 2,474,293. Preferred examples of such naphthol couplers include oxygen atom-releasing type two-equivalent couplers as described in U.S. Pat. Nos. 4,052,212, 4,146,396, 4,228,233 and 4,296,200. Specific examples of the phenol couplers are described in U.S. Pat. Nos. 2,369,929, 2,801,171, 2,772,162 and 2,895,826. Cyan couplers fast to heat and moisture can be preferably used in the present invention. Typical examples of such cyan couplers include phenol cyan couplers containing an ethyl group or higher alkyl group at the meta-position of the phenol nucleus as described in U.S. Pat. No. 3,772,002, 2,5-diacylamino-substituted phenol couplers as described in U.S. Pat. Nos. 2,772,162, 3,758,308, 4,126,396, 4,334,011 and 4,327,173, West German Patent Application (OLS) No. 3,327,729, and Japanese Patent Application (OPI) No. 166956/84, and phenol couplers containing a phenylureido group at the 2-position and an acylamino group at the 5-position as described in U.S. Pat. Nos. 3,446,622, 4,333,999, 4,451,559 and 4,427,767.

The graininess of the emulsion can be improved by using a coupler which forms a dye having a proper diffusibility in combination with these couplers. Specific examples of such dye diffusive couplers include magenta couplers as described in U.S. Pat. No. 4,366,237, and British Patent 2,125,570, and yellow, magenta, and cyan couplers as described in European Patent 96,570, and West German Patent Application (OLS) No. 3,234,533.

Such dye forming couplers and the above mentioned special couplers may form a dimer or higher polymer. Specific examples of polymerized dye forming couplers are described in U.S. Pat. Nos. 3,451,820 and 4,080,211. Specific examples of polymerized magenta couplers are described in British Patent 2,102,173 and U.S. Pat. No. 4,367,282.

In order to satisfy the properties required for the present photographic material, these various couplers which can be used in the present invention may be incorporated in combination into the same layer in the light-sensitive layers or singly in two or more light-sensitive layers.

The incorporation of the couplers in the light-sensitive material can be accomplished by the oil-in-water dispersion process. In the oil-in-water dispersion process, dispersion process. In the oil-in-water dispersion process, a coupler of the present invention is dissolved in either of a high boiling organic solvent having a boiling point of 175° C. or above or a so-called auxiliary solvent having a lower boiling point or a mixture thereof. The solution thus prepared is then finely dispersed in water or an aqueous medium such as aqueous gelatin solution in the presence of a surface active agent. Examples of such a high boiling organic solvent are described in U.S. Pat. No. 2,322,027. The dispersion may involve phase inversion. The auxiliary solvent may be optionally removed or reduced by distillation, noodle washing, or ultrafiltration before the emulsion is coated on a support.

Specific examples of the high boiling organic solvent include phthalic esters such as dibutyl phthalate, dicyclohexyl phthalate, di-2-ethylhexyl phthalate, and decyl phthalate, phosphoric or phosphonic esters such as triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, and di-2-ethylhexylphenyl phosphonate, benzoic esters such as 2-ethylhexyl benzoate, dodecyl benzoate and 2-ethylhexyl-p-hydroxybenzoate, amides such as diethyldodecanamide and N-tetradecylpyrrolidone, alcohols or phenols such as isostearyl alcohol and 2,4-di-tert-amylphenol, aliphatic carboxylic esters such as dioctyl azerate, glycerol tributylate, isostearyl lactate, and trioctyl citrate, aniline derivatives such as N,N-dibutyl-2-butoxy-5-tert-octylaniline, and hydrocarbons such as paraffin, dodecylbenzene, and diisopropyl naphthalene. Suitable auxiliary solvents which can be used include an organic solvent having a boiling point of about 30° C. or higher, preferably between 50° C. and about 160° C. Typical examples of such organic solvents include ethyl acetate, butyl acetate, ethyl propionate, methyl ethyl ketone, cyclohexanone, 2-ethoxyethyl acetate, and dimethylformamide.

Specific examples of the procedures and effects of the latex dispersion process and latexes to be used for impregnation are described in U.S. Pat. No. 4,199,363, and West German Patent Application (OLS) Nos. 2,541,274 and 2,541,230.

The standard amount of the present color coupler to be used is 0.01 to 1.0 mol %, preferably 0.1 to 0.6 mol per mol of the light-sensitive silver halide.

The silver halide color photographic material of this invention may contain a hydroquinone derivative, aminophenol derivative, amine, gallic acid derivative, catechol derivative, ascorbic acid derivative, colorless coupler, sulfonamide phenol derivative or the like as a color fog inhibitor or color stain inhibitor.

The silver halide color photographic material of this invention may comprise any suitable discoloration inhibitor. Typical examples of an organic discoloration inhibitor include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives obtained by silylating or alkylating phenolic hydroxyl groups thereof. Metal complexes such as (bissalicylaldoximate)nickel complex and (bis-N,N-dialkyldithiocarbamate)nickel complex may be used.

Compounds containing both hindered amine and hindered phenol moieties in the same molecule as described in U.S. Pat. Nos. 4,268,593 provide good results in inhibiting deterioration of yellow dye due to heat, light and moisture. Spiroindans as described in Japanese Patent Application (OPI) No. 159644/81 and hydroquinonediether- or monoether-substituted chromans as described in Japanese Patent Application (OPI) No. 89835/80 provide good effects of inhibiting deterioration of magenta dye, especially due to light.

In order to improve fastness of cyan dye, especially to light, a benzotriazole ultraviolet absorber can be preferably used. Such an ultraviolet absorber may be coemulsified with a cyan coupler.

The ultraviolet absorber may be used in an amount sufficient to render the cyan dye image fast to light. However, if it is used in too large an amount, it causes yellowing in the unexposed area (white background) of the color photographic light-sensitive material. Generally, a preferred coating amount of the ultraviolet absorber is in the range of from $1\times10^{-4}$ to $2\times10^{-3}$ mol/m$^2$, more preferably from $5\times10^{-4}$ to $1.5\times10^{-3}$ mol/m$^2$.

In the normal light-sensitive structure of color paper, an ultraviolet absorber is incorporated into either or both of the two layers adjacent to the cyan coupler-containing red-sensitive emulsion layer. When an ultraviolet absorber is incorporated into the intermediate layer between the green-sensitive layer and the red-sensitive layer, it may be coemulsified with a color stain inhibitor. When an ultraviolet absorber is incorporated into a protective layer, another protective layer is provided as an outermost layer. This protective layer may contain a matting agent having any suitable particle diameter.

The photographic emulsion layer or other hydrophilic colloidal layers of the silver halide color photographic material of this invention may contain a stilbene, triazine, oxazole or coumarin brightening agent. As brightening agents, a water-soluble brightening agent may be used. Alternatively, a dispersion of a water-insoluble brightening agent may be used.

As previously mentioned, the present invention can be applied to a multilayer multicolor photographic light-sensitive material having at least two different spectral sensitivities on a support. In general, a silver halide color photographic material comprises at least one red-sensitive emulsion layer, one green-sensitive emulsion layer, and one blue-sensitive emulsion layer on a support. The order of arrangement of these emulsion layers can be optionally selected. Each of these emulsion layers may be composed of two or more emulsion layers having different sensitivities. Alternatively, a light-insensitive layer may be present interposed between two or more emulsion layers having the same sensitivity. The support is preferably a reflective support.

The silver halide color photographic material of this invention optionally, but preferably, comprise auxiliary layers such as protective layer, intermediate layer, filter layer, antihalation layer, and back layer in addition to the silver halide emulsion layer.

As a suitable binder or protective colloid for the emulsion layer or intermediate layer in the present silver halide color photographic material, gelatin is advantageously used. Other hydrophilic colloids may also be used.

Examples of such other hydrophilic colloids which can be used in the present invention include proteins such as gelatin derivatives, graft polymers of gelatin with other high molecular compounds, albumin, and casein, cellulose derivatives such as hydroxyethyl cellulose, carboxymethyl cellulose, and cellulose sulfuric esters, sodium alginate, sugar derivatives such as starch derivatives, and various synthetic hydrophilic high molecular substances such as polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, and other single polymers or copolymers.

Suitable gelatin includes lime-processed gelatin, acid-processed gelatin, or oxygen-processed gelatin as described in *Bull. Soc. Sci. Phot. Japan,* No. 16, page 30 (1966). Alternatively, hydrolyzates or enzymatically decomposed products of gelatin can be used.

The silver halide color photographic material of this invention may also comprise various stabilizers, pollution inhibitors, developing agents or precursors thereof, development accelerators or precursors thereof, lubricants, mordants, matting agents, antistatic agents, plasticizers, or other various additives useful for photographic light-sensitive materials besides the above mentioned additives. Typical examples of such additives are described in *Research Disclosure* Nos. 17643 (December 1978) and 18716 (November 1979).

The term "reflective support" as used herein means a support which raises the reflecting properties of the light-sensitive material to make dye images formed on the silver halide emulsion layer or adjacent layers sharp. Examples of such a reflective support include a hydrophobic resin containing a light reflecting substance dispersed therein and a support coated with such a hydrophobic resin containing a light reflecting substance such as titanium oxide, zinc oxide, calcium carbonate, and calcium sulfate dispersed therein. Examples of such supports include baryta paper, polyethylene-coated paper, polypropylene synthetic paper, and transparent supports such as glass plate, polyester film, e.g., polyethyleneterephthalate, cellulose triacetate, and cellulose nitrate, polyamide film, polycarbonate film, and polystyrene film comprising a reflective layer or a reflective substance applied thereto. These supports can be properly selected depending on the purpose of use.

The coating of the hydrophilic colloidal layer on the light-sensitive layer and light-insensitive layer can be accomplished any suitable coating process such as dip coating process, roller coating process, curtain coating process, and extrusion coating process. A coating process as described in U.S. Pat. Nos. 2,681,294, 2,761,791, 3,508,947 and 3,526,528 can be optionally used to apply a plurality of layers at the same time.

The development process (image formation process) in the present invention will be described hereinafter.

The development process is not specifically limited, and any suitable conventional method can be used in the present invention. Typical examples of such methods include a process which comprises exposure, color development, blix, and optional washing and stabilization, a process which comprises exposure, color development, bleach and fixing which are separately effected, and optional washing and stabilization, a process which comprises exposure, development with a developing solution containing a black-and-white developing agent, uniform exposure, color development, bleach, and optional washing and stabilization, and a process which comprises exposure, development with a developing solution containing a black-and-white developing agent, development with a color developing solution containing a fogging agent such as sodium borohydride, blix, and optional washing and stabilization.

Examples of aromatic primary amine color developing agents which can be used in the present color developing solution include known aromatic primary amine color developing agents commonly used in various color photographic processes. These developing agents include aminophenol and p-phenylenediamine derivatives. Preferred among these derivatives are p-phenylenediamine derivatives. Typical examples of such compounds will be shown hereinafter, but the present invention should not be construed as being limited thereto.

D-1 N,N-diethyl-p-phenylenediamine

D-2 2-Amino-5-diethylaminotoluene

D-3 2-Amino-5-(N-ethyl-N-laurylamino)toluene

D-4 4-[N-ethyl-N-(β-hydroxyethyl)amino]aniline

D-5 2-Methyl-4-[N-ethyl-N-(β-hydroxyethyl-)amino]aniline

D-6 N-Ethyl-N-(β-methanesulfonamideethyl)-3-methyl-4-amino-aniline

D-7 N-(2-amino-5-diethylaminophenylethyl)methanesulfonamide

D-8 N,N-dimethyl-p-phenylenediamine

D-9 4-Amino-3-methyl-N-ethyl-N-methoxyethylaniline

D-10 4-Amino-3-methyl-N-ethyl-N-β-ethoxyethylaniline

D-11 4-Amino-3-methyl-ethyl-N-β-butoxyethylaniline

Other examples of such p-phenylenediamine derivative include salts such as sulfates, hydrochlorides, sulfites, and p-toluenesulfonates. These compounds are described in U.S. Pat. Nos. 2,193,015, 2,552,241, 2,566,271, 2,592,364, 3,656,950 and 3,698,525. The amount of the aromatic primary amine color developing agent to be used is preferably about 0.1 to about 20 g, more preferably about 0.5 to about 10 g per liter of developing solution.

As well known, the color developing solution to be used in the present invention can contain a hydroxylamine.

Such a hydroxylamine may be used in the form of a free amine in the color developing solution but is generally used in the form of a water-soluble acid salt. General examples of such acid salts include sulfates, oxalates, chlorides, phosphates, carbonates, and acetates. Such hydroxylamines may be substituted or unsubstituted. The nitrogen atoms contained in the hydroxylamine may be substituted with alkyl groups.

The hydroxylamine is preferably added in an amount of from 0 to 10 g, more preferably 0 to 5 g per liter of color developing solution. A smaller amount of the hydroxylamine is preferred so long as the stability of the color developing solution can be maintained.

The preservatives which can be used include sodium sulfite, potassium sulfite, sodium bisulfite, potassium bisulfite, sodium methasulfite, potassium methasulfite, or carbonyl sulfurous acid addition product. The preservative is preferably added in an amount of from 0 to 20 g/l, more preferably 0 to 5 g/l. A smaller amount of the preservative is preferred so long as the stability of the color developing solution can be maintained.

Other examples of suitable preservatives include aromatic polyhydroxy compounds as described in Japanese Patent Application (OPI) Nos. 49828/77, 47038/81, 32140/81 and 160142/84, and U.S. Pat. No. 3,746,544, hydroxylacetones as described in U.S. Pat. No. 3,615,503, and British Patent 1,306,176, α-aminocarbonyl compounds as described in Japanese Patent Application (OPI) Nos. 143020/77 and 89425/78, various metals as described in Japanese Patent Application (OPI) Nos. 44148/82 and 53749/82, various sugars as described in Japanese Patent Application (OPI) No. 102727/77, hydroxamic acids as described in Japanese Patent Application (OPI) No. 27638/77, α,α'-dicarbonyl compounds as described in Japanese Patent Application (OPI) No. 16014/84, salicylic acids as described in Japanese Patent Application (OPI) No. 180588/84, alkanolamines as described in Japanese Patent Application (OPI) No. 3532/79, poly(alkyleneimines) as described in Japanese Patent Application (OPI) No. 94349/81, and gluconic acid derivatives as described in Japanese Patent Application (OPI) No. 75647/81. These preservatives may be used, singly or in combination. Particularly, 4,5-dihydroxy-m-benzenedisulfonic acid, poly(ethyleneimine), triethanolamine or the like is preferably used.

The pH value of the color developing solution to be used in the present invention is preferably 9 to 12, more preferably 9 to 11. The present color developing solution may contain compounds of known components of developing solution.

In order to maintain the above pH value, various buffers are preferably used. Examples of such buffers which may be used in the present invention include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Particularly preferred among these buffers are carbonates, phosphates, tetraborates, and hydroxybenzoates. These buffers are advantageous in that they are excellent in solubility and buffer capacity in a high pH range of 9.0 or more, giving no adverse effects (e.g., fog) to the photographic properties when added to the color developing solution. These buffers are also advantageous in that they are inexpensive.

Specific examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of the buffer to be added to the color developing solution is preferably 0.1 mol or more, more preferably 0.1 mol to 0.4 mol per liter of the developing solution.

The present color developing solution may comprise various chelating agents as calcium or magnesium precipitation inhibitors or in order to improve the stability thereof.

As suitable chelating agents there can be used organic compounds. Examples of such organic compounds include aminopolycarboxylic acids as described in Japanese Patent Publication Nos. 030496/73 and 30232/69, organic phosphonic acids as described in Japanese Patent Application (OPI) No. 97347/81, Japanese Patent Publication No. 39359/81, and West German Patent No. 2,227,639, phosphonocarboxylic acids as described in Japanese Patent Application (OPI) Nos. 102726/77, 42730/78, 121127/79, 126241/80 and 65956/80, and compounds as described in Japanese Patent Application (OPI) Nos. 195854/83 and 203440/83, and Japanese Patent Publication No. 40900/78. Specific examples of such compounds will be shown hereinafter, but the present invention should not be construed as being limited thereto.

Nitrilotriacetic acid
Diethyleneamino pentaacetic acid
Ethylenediamine tetraacetic acid
Triethylenetetramine hexaacetic acid
N,N,N-trimethylenephosphonic acid
Ethylenediamine-N,N,N',N'-tetramethylenephosphonic acid
1,3-Diamino-2-propanol-tetraacetic acid
Transcyclohexanediamine tetraacetic acid
Nitrilotripropionic acid
1,2-Diaminopropane tetraacetic acid
Hydroxyethylimino diacetic acid
Glycol ether diamine tetraacetic acid
Hydroxyethylenediamine tetraacetic acid
Ethylenediamineorthohydroxyphenylacetic acid
2-Phosphonobutane-1,2,4-tricarboxylic acid
1-Hydroxyethane-1,1-diphosphonic acid
N,N'-bis(2-hydroxybenzyl)ethylenediamine-N,N'-diacetic acid These chelating agents may be optionally used in combination. These chelating agents can be added in an amount sufficient to block metallic ions in the color developing solution, for example, in the range of from about 0.1 to about 10 g per liter of the developing solution.

The present color developing solution may optionally comprise any suitable development accelerator.

Examples of suitable development accelerators which can be optionally used in the present invention include thioether compounds as described in Japanese Patent Publication Nos. 16088/62, 5987/62, 7826/63, 12380/69 and 9019/70, and U.S. Pat. No. 3,813,247, p-phenylenediamine compounds as described in Japanese Patent Application (OPI) Nos. 49829/77 and 15554/75, quaternary ammonium salts as described in Japanese Patent Application (OPI) Nos. 137726/75, 156826/81 and 43429/77, and Japanese Patent Publication No. 30074/69, p-aminophenols as described in U.S. Pat. Nos. 2,610,122 and 4,119,462, amine compounds as described in U.S. Pat. Nos. 2,494,903, 3,128,182, 4,230,796 and 3,253,919, Japanese Patent Publication No. 11431/66, and U.S. Pat. Nos. 2,482,546, 2,596,926 and 3,582,346, polyalkyleneoxide as described in Japanese Patent Publication Nos. 16088/62, 252201/67, 11431/66 and 23883/67, and U.S. Pat. Nos. 3,128,183 and 3,532,501, 1-phenyl-3-pyrazolidones, hydrazines, mesoion type compounds, thione type compounds, and imidazoles. Particularly preferred among these compounds are thioether compounds and 1-phenyl-3-pyrazolidones.

The present color developing solution may optionally comprise any suitable anti-foggant. Suitable anti-foggants which can be used include halides of alkali metals such as potassium bromide, sodium chloride and potassium iodide, and organic anti-foggants. Examples of such organic anti-foggants which can be used in the present invention include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, and 2-thiazolylmethylbenzimidazole, mercapto-substituted heterocyclic compounds such as 1-mercaptobenzimidazole, and 2-mercaptobenzothiazole, adenine, and mercapto-substituted aromatic compounds such as thiosalicylic acid. These anti-foggants may be eluted from the silver halide color photographic material during the processing, and accumulated in the color developing solution. However, the accumulated amount of the anti-foggant thus eluted is preferably as low as possible.

The color developing solution preferably contains a fluorescent brightening agent. Suitable fluorescent brightening agent which can be used include a 4,4-diamino-2,2'-disulfostilben compound. The amount of such a fluorescent brightening agent is preferably from 0.1 to 2 g per liter.

The color developing solution may optionally comprise various surface active agents such as alkylphosphonic acid, arylphosphonic acid, aliphatic carboxylic acid, and aromatic carboxylic acid.

In the present invention, the processing temperature of the color developing solution is preferably 30° to 50° C, more preferably 33° to 42° C. The amount of the color developing solution to be replenished is 30 to 20,000 ml, prefer ably 30 to 1,500 ml per $m^2$ of the light-sensitive material. In order to reduce the amount of waste solution, the amount of the color developing solution to be replenished is preferably as low as possible.

Suitable bleach or blix solution used for the present invention is a complex ferric salt solution. Such a complex ferric ion salt is a complex of ferric ion with a chelating agent such as aminopolycarboxylic acid, aminopolyphosphonic acid, and salts thereof. Such an aminopolycarboxylate or aminopolyphosphonate include a salt of aminopolycarboxylic acid or aminopolyphosphonic acid with an alkali metal, ammonium, or water-soluble amine. Examples of alkali metals include sodium, potassium, and lithium. Examples of water-soluble amines include alkylamine such as methylamine, diethylamine, triethylamine, and butylamine, alicyclic amine such as cyclohexylamine, arylamine such as aniline, and n-toluidine, and heterocyclic amine such as pyridine, morpholine, and piperidine.

Typical examples of aminopolycarboxylic acid, aminopolyphosphonic acid, and salts thereof as chelating agents include ethylenediamine tetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, propylenediaminetetraacetic acid, disodium propylenediaminetetraacetate, nitrilotriacetic acid, trisodium nitrilotriacetate, cyclohexanediaminetetraacetic acid, disodium cyclohexanediaminetetraacetate, iminodiacetic acid, dihydroxyethylglycine, ethyletherdiaminetetraacetic acid, glycoletherdiaminetetraacetic acid, ethylenediaminetetrapropionic acid, phenylenediaminetetraacetic acid, 1,3-diaminepropanol-N,N,N',N'-tetramethylene phosphonic acid, ethylenediamine-N,N,N',N'-tetramethylenephosphonic acid, and 1,3-propylenediamine-N,N,N',N'-tetramethylenephosphonic acid. Of course, the present invention is not limited to these compounds.

Such a ferric ion complex salt may be used in the form of a complex salt or produced from ferric sulfate, ferric chloride, ferric nitrate, ferric ammonium sulfate, or ferric phosphate in a solution in the presence of a chelating agent such as aminopolycarboxylic acid, aminopolyphosphonic acid, and phosphonocarboxylic acid. If the ferric ion complex salt is used in the form of a complex salt, one or more complex salts may be used, singly or in combination. On the other hand, if it is produced from a ferric salt and a chelating agent in a solution, one or more ferric salts may be used, singly or in combination. Furthermore, one or more chelating agents may be used, singly or in combination. In any case, such a chelating agent may be used in an amount exceeding that required to produce the ferric ion complex salt. Preferred among these iron complexes is an aminopolycarboxylic acid-iron complex. The iron complex is used in an amount of from 0.01 to 1.0 mol/l, preferably 0.05 to 0.50 mol/l.

The present invention or blix solution may optionally comprise a bleach accelerator. Specific examples of useful bleach accelerators include compounds containing mercapto groups or disulfide groups as described in U.S. Pat. No. 3,893,858, West German Patent Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 124424/78, 141623/78 and 28426/78, and *Research Disclosure* No. 17129 (July, 1978), thiazolidine derivatives as described in Japanese Patent Application (OPI) No. 140129/75, thiourea derivatives as described in Japanese Patent Publication No. 8506/70, Japanese Patent Application (OPI) Nos. 20832/77 and 32735/78, and U.S. Pat. No. 3,706,561, iodides as described in West German Patent No. 1,127,715, and Japanese Patent Application (OPI) No. 16235/83, polyethylene oxides as described in West German Patent Nos. 966,410 and 2,748,430, polyamine compounds as described in Japanese Patent Publication No. 8836/70, compounds as described in Japanese Patent Application (OPI) Nos. 42434/74, 59644/74, 94927/78, 35727/79, 26506/80 and 163940/83, and iodine and bromine ions. Preferred among these compounds are those containing mercapto groups or disulfide groups which are effective for accelerating bleach. Particularly preferred among these compounds are those described in U.S. Pat. No. 3,893,858, West German-Patent No. 1,290,812, and Japanese Patent Application (OPI) No. 95630/78.

The bleach or blix solution may also contain a rehalogenating agent, e.g., a bromide such as potassium bromide, sodium bromide, and ammonium bromide, a chloride such as potassium chloride, sodium chloride, and ammonium chloride, or an iodide such as ammonium iodide. Furthermore, the bleach or blix solution may contain one or more inorganic or organic acids and alkali metal or ammonium salts thereof having a pH buffer capacity such as boric acid, sodium methaborate, acetic acid, sodium acetate, sodium carbonate, potassium carbonate, sulfurous acid, phosphoric acid, sodium phosphate, citric acid, sodium citrate, and tartaric acid, or a corrosion inhibitor such as ammonium nitrate, and guanidine.

Examples of fixing agents for the bleach or blix solution include known fixing agents such as thiosulfates, e.g., sodium thiosulfate, and ammonium thiosulfate, thiocyanates, e.g., sodium thiocyanate, and ammonium thiocyanate, thioether compounds, e.g., ethylenebisthioglycolic acid, and 3,6-dithia-1,8-octanediol, and water-soluble silver halide solvents, e.g., thiourea. These fixing agents may be used, singly or in admixture. Alternatively, a spectral blix solution comprising a combination of a fixing agent and a large amount of a halide such as potassium iodide as described in Japanese Patent Application (OPI) No. 155354/80 may be used. In the present invention, thiosulfates, particularly ammonium thiosulfate, are preferably used.

The fixing agent is preferably used in an amount of from 0.3 to 2 mol/l, more preferably 0.5 to 1.0 mol/l.

The pH value of the bleach or blix solution is preferably in the range of 3 to 10, more preferably in the range of 4 to 9. If the pH value is lower than the above range, the desilvering capacity of the solution is improved, but deterioration of the solution and conversion of the cyan dye into a leuco dye are accelerated. Contrary, if the pH value is higher than the above range, rate of desilvering decreases and color stain tends to occur.

In order to adjust the pH value, the bleach or blix solution may optionally contain hydrochloric acid, sulfuric acid, nitric acid, acetic acid (glacial), bicarbonate, ammonia, potassium hydroxide, sodium hydroxide, sodium carbonate, potassium carbonate, or the like.

The blix solution may also contain various fluorescent brightening agents, anti-foaming agents or surface active agents, or organic solvents such as polyvinyl pyrrolidone, and methanol.

The bleach or blix solution contains a sulfurous ion-releasing compound such as sulfite, e.g., sodium sulfite, potassium sulfite, and ammonium sulfite, bisulfite, e.g., ammonium bisulfite, sodium bisulfite, and potassium bisulfite, and metabisulfite, e.g., potassium metabisulfite, sodium metabisulfite, and ammonium metabisulfite as preservatives. These compounds are preferably contained in the solution in an amount of about 0.02 to 0.50 mol/l, particularly 0.04 to 0.40 mol/l in terms of sulfurous ion.

The preservatives are generally sulfites. Other examples of preservatives which may be used in the present invention include ascorbic acid, carbonyl bisulfurous acid addition products, and carbonyl compounds.

Furthermore, buffers, fluorescent brightening agent, chelating agents, antimolds, or the like may be optionally used.

The washing process of the present invention will be described hereinafter. In the present invention, the ordinary "washing process" can be replaced by a simple processing method in which the substantial washing process is not conducted but only the so-called "stabilizing process" is conducted. Thus, the term "washing process" as used herein has such a wide broad meaning.

In the present invention, the amount of washing water depends on the number of multistage counterflow washing baths and the amount of prebath components conveyed with the light-sensitive material being processed. Thus, it is difficult to specify the amount of washing water. However, the value in the present invention may be such that the content of the blix solution component in the final washing bath is less than $1\times10^{-4}$. For example, if a 3-tank counterflow washing system is used, the value is preferably about 1,000 ml, particularly 5,000 ml per $m^2$ of the light-sensitive material. If a water-saving system is used, the value is preferably 100 to 1,000 ml per $m^2$ of the light-sensitive material.

The washing temperature is 15° to 45° C., preferably 20° to 35° C.

In the washing process, various known compounds may be used in order to inhibit precipitation or stabilize the washing water. Examples of such known compounds which can be optionally used in the present invention include chelating agents such as inorganic phosphoric acid, aminopolycarboxylic acid, and organic phosphonic acid, antibacterial and antifungal agents for preventing the generation of various bacteria and molds such as compounds as described in *Journal of Antibacterial and Antifungal Agents,* Vol. 11, No. 5, pp. 207-223, 1983, and *Antibacterial and Antifungal Chemistry,* edited by Hiroshi Horiguchi, metal salts and alkali salts such as magnesium salts and aluminum salts, ammonium salts, and surface active agents for inhibiting drying load or mark. Alternatively, compounds as described in *Photographic Science and Engineering,* Vol. 6, pp. 344-359, 1965 may be used.

The present invention is particularly effective in the case where a multistage counterflow washing system comprising two or more tanks using washing water containing a chelating agent, antibacterial agent, and antifungal agent is used to drastically save the amount of washing water. The present invention is also effective in the case where a multistage counterflow stabilizing process (so-called stabilizing process) as described in Japanese Patent Application (OPI) No. 8543/82 is effected. In such a case, the content of the blix solution component in the final bath is preferably $5\times10^{-2}$ or less, particularly $1\times10^{-2}$ or less.

The present stabilizing bath may comprise various compounds for the purpose of stabilizing the image. Typical examples of such compounds include various buffers for adjusting the pH of the film such as combinations of borates, methaborates, borax, phosphates, carbonates, potassium hydroxide, sodium hydroxide, ammonia water, monocarboxylic acid, dicarboxylic acid, polycarboxylic acid, and the like, and aldehyde such as formaldehyde. Other examples of compounds which can be used in the present invention include chelating agents such as inorganic phosphoric acid, aminopolycarboxylic acid, organic phosphonic acid, aminopolyphosphonic acid, and phosphonocarboxylic acid, antibacterial agents such as thiazole, isothiazole, halogenated phenol, sulfanylamide, and benzotriazole, surface active agents, fluorescent brightening agents, film hardeners, and other various additives. These additives of the same or different purposes can be used in combination.

In order to improve the stability of the image, various ammonium salts such as ammonium chloride, ammonium nitrate, ammonium sulfate, ammonium phosphate, ammonium sulfite, and ammonium thiosulfate are preferably used as an agent for film pH adjustment in the processing apparatus.

In the case where the amount of washing water is saved as mentioned above, part or whole of the overflow solution of washing water is preferably allowed to flow into the prebath, i.e., blix or bleach bath to reduce the amount of waste solution.

In a continuous processing step, each processing solution can be properly replenished to prevent possible fluctuation in the solution composition so that a constant finish can be obtained. The amount of replenisher can be reduced to half the standard amount of replenisher or less to save the cost.

Each processing bath may be optionally equipped with a heater, temperature sensor, liquid level sensor, circulating pump, filter, various floating cover, various squeegees, nitrogen agitator, air agitator, or the like.

The present process can be applied to any processing step so long as a color developing solution is used. For example, the present process can be applied to the processing of color paper, color reversal paper, color positive film, color negative film, color reversal film, or the like.

The present invention is further illustrated in greater detail by the following examples, but is not limited thereto. Unless otherwise indicated, all percents, parts, ratios and the like are by weight.

EXAMPLE 1

A silver halide emulsion (1) for a blue-sensitive silver halide emulsion layer was prepared as follows:

| | |
|---|---|
| Solution 1 | |
| $H_2O$ | 1,000 cc |
| NaCl | 8.8 g |
| Gelatin | 25 g |
| Solution 2 | |
| Sulfuric acid (1N) | 20 cc |
| Solution 3 | |
| Silver halide solvent having the following formula (1%) | 3 cc |

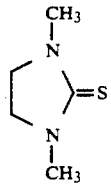

| | |
|---|---|
| Solution 4 | |
| KBr | 14.01 g |
| NaCl | 1.72 g |
| $H_2O$ to make | 130 cc |
| Solution 5 | |
| $AgNO_3$ | 25 g |
| $H_2O$ to make | 130 cc |

-continued

| | |
|---|---|
| Solution 6 | |
| KBr | 56.03 g |
| NaCl | 6.88 g |
| $K_2IrCl_6$ (0.001%) | 1 cc |
| $H_2O$ to make | 285 cc |
| Solution 7 | |
| $AgNO_3$ | 100 g |
| $H_2O$ to make | 285 cc |

Solution 1 was heated to a temperature of 75° C., and Solution 2 and Solution 3 were then added to Solution 1. Thereafter, Solution 4 and Solution 5 were added to the resulting mixture at the same time over a period of 40 minutes. After 10 minutes, Solution 6 and Solution 7 were added to the mixture at the same time over a period of 25 minutes. After 5 minutes, the mixture was allowed to cool, and then desalted. Water and a dispersion of gelatin were added to the mixture. The pH of the mixture was adjusted to 6.2 to obtain a monodisperse cubic silver chlorobromide emulsion with an average particle size of 1.01 μm and a deviation coefficient (a value obtained by dividing the standard deviation by the average particle size: s/d) of 0.08 containing 80 mol % of silver bromide. Sodium thiosulfate was added to the emulsion thus obtained to effect the optimum chemical sensitization.

Silver halide emulsions 2 to 4 for a blue-sensitive silver halide emulsion layer were prepared in the same manner as described above except that the amount of Solution 1 and Solution 3, the temperature at which these solutions were added, and the time required for the addition of these solutions were changed. Furthermore, a silver halide emulsion 5 for a green-sensitive silver halide emulsion layer and a silver halide emulsion 6 for a red-sensitive silver halide emulsion layer were prepared in the same manner as described above except that the amounts of Solution 1, Solution 3, Solution 4, and Solution 6, the temperature at which these solutions were added, and the time required for the addition of these solutions were changed.

The average particle size, deviation coefficient, halogen composition, and K value of silver halide emulsions 1 to 6 are shown in Table 1.

TABLE 1

| Emulsion | Average particle size (μm) | Fluctuation coefficient (s/d) | Halogen Br % | Composition Cl % | K value |
|---|---|---|---|---|---|
| 1 | 1.01 | 0.08 | 80 | 20 | ∞ |
| 2 | 0.98 | 0.08 | 80 | 20 | 6.4 |
| 3 | 1.00 | 0.09 | 80 | 20 | 2.1 |
| 4 | 0.99 | 0.10 | 80 | 20 | 0.3 |
| 5 | 0.52 | 0.09 | 80 | 20 | ∞ |
| 6 | 0.60 | 0.07 | 70 | 30 | ∞ |

A silver halide color photographic material A comprising the layer structure shown in Table 2 on a paper support laminated with polyethylene on both sides thereof was prepared.

The coating solutions used were prepared as follows:

Coating Solution for 1st Layer 27.2 cc of ethyl acetate and 6.3 cc of Solvent (c) were dissolved in 16.6 g of Yellow Coupler (a) and Dye Stabilizer (b). The resulting solution was then added to 150 cc of a 10% aqueous solution containing 8 cc of 10% sodium dibutylnaphthalenesulfonate. The mixture was subjected to emulsion dispersion by a continuous stirrer to obtain an emulsion dispersion.

On the other hand, the spectral sensitizer described below was added to a silver halide emulsion (1) (silver bromide: 80 mol %; silver: 70 g/kg) in an amount of $7.0\times10^{-4}$ mol per mol of silver halide to prepare 90 g of a blue-sensitive silver halide emulsion.

The emulsion dispersion and the silver halide emulsion thus obtained were mixed, and the gelatin concentration of the mixture thus obtained was properly adjusted so as to obtain the composition shown in Table 2 thereby to prepare the coating solution for the 1st layer.

The coating solutions for the 2nd to the 7th layers were prepared in the same manner as that for the 1st layer.

As the gelatin hardener for each layer, 1-oxy-3,5-dichloro-s-triazine sodium salt was used.

The spectral sensitizers for these silver halide emulsions were as follows:

Blue-sensitive emulsion layer

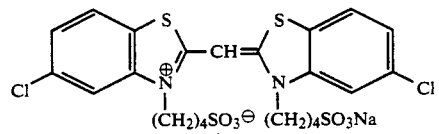

(Added amount: $7.0\times10^{-4}$ mol per mol of silver halide)

Green-sensitive emulsion layer

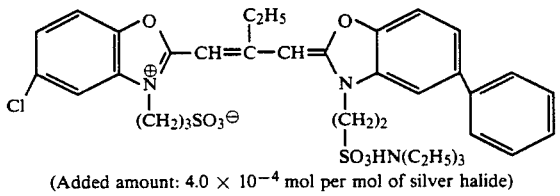

(Added amount: $4.0\times10^{-4}$ mol per mol of silver halide)

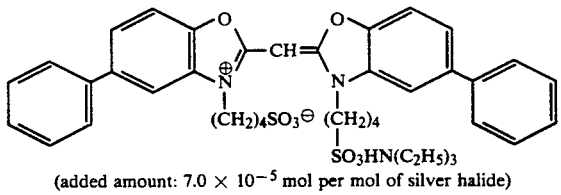

(added amount: $7.0\times10^{-5}$ mol per mol of silver halide)

Red-sensitive emulsion layer

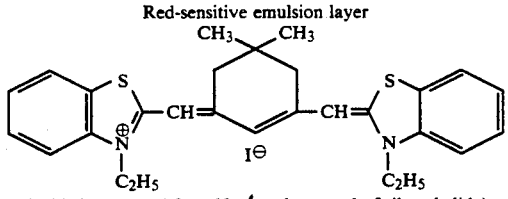

(Added amount: $1.0\times10^{-4}$ mol per mol of silver halide)

The formulae of couplers and other compounds used in Example are as follows:

(a) Yellow coupler

-continued
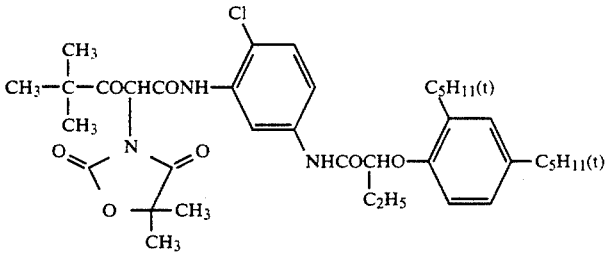
(b) Dye stabilizer
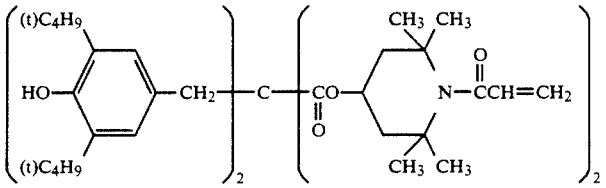
(c) Solvent
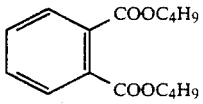
(d) Color stain inhibitor
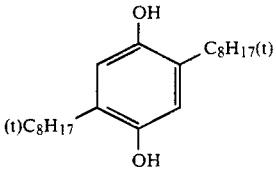
(e) Solvent
(iso $C_9H_{19}O)_3P{=}O$
(f) Magenta coupler
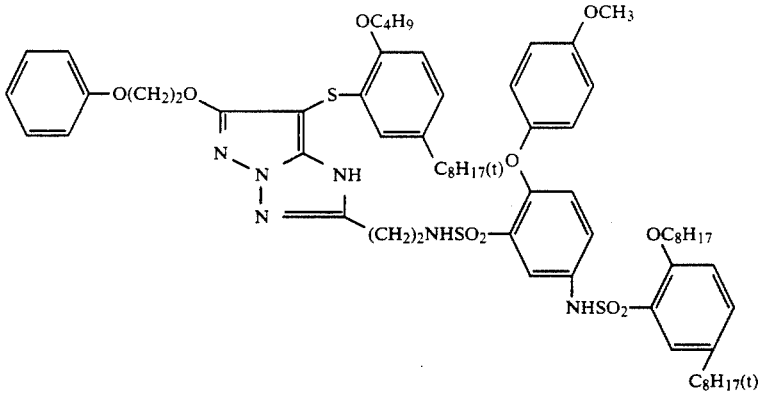
(g) Dye stabilizer
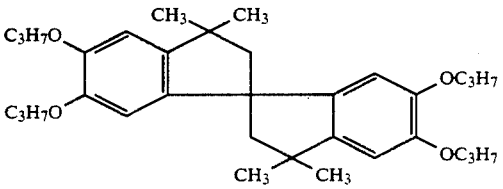
(h) Solvent -continued
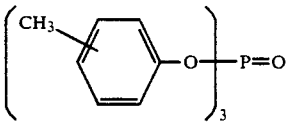
(i) Ultraviolet absorber
1:5:3 mixture (molar ratio) of
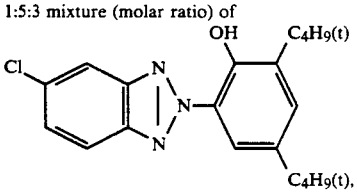
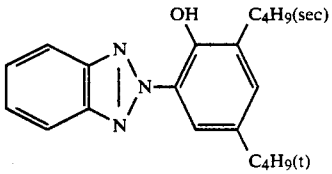
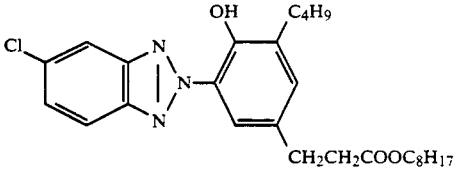
(j) Cyan coupler
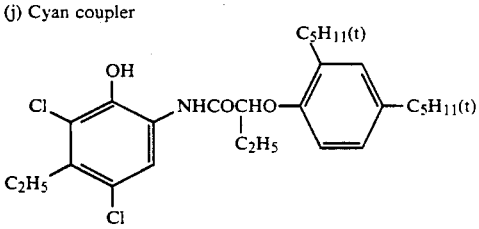
(k) Ultraviolet absorber
1:3:3 mixture (molar ratio) of
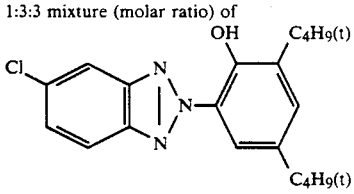
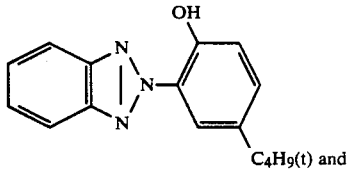
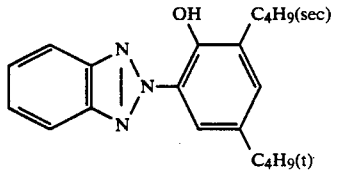
TABLE 2
| | Main Composition | Used Amount |
|---|---|---|
| 7th Layer | Gelatin | 1.33 g/m$^2$ |
TABLE 2-continued
| | Main Composition | Used Amount |
|---|---|---|
| protective | Acryl-modified copolymer | 0.17 g/m$^2$ |

TABLE 2-continued

| | Main Composition | Used Amount |
|---|---|---|
| layer) | of polyvinyl alcohol (modification degree: 17%) | |
| 6th Layer (ultraviolet absorbing layer) | Gelatin | 0.54 g/m$^2$ |
| | Ultraviolet absorber (i) | 0.21 g/m$^2$ |
| | Solvent (e) | 0.09 cc/m$^2$ |
| 5th Layer (red-sensitive layer) | Silver halide emulsion (6) (silver bromide 70 mol %) | 0.22 g/m$^2$ (in terms of silver) |
| | Gelatin | 0.90 g/m$^2$ |
| | Cyan coupler (j) | 0.36 g/m$^2$ |
| | Dye stabilizer (k) | 0.17 g/m$^2$ |
| | Solvent (h) | 0.22 cc/m$^2$ |
| 4th Layer (ultraviolet absorbing layer) | Gelatin | 1.60 g/m$^2$ |
| | Ultraviolet absorber (i) | 0.62 g/m$^2$ |
| | Color stain inhibitor (d) | 0.05 g/m$^2$ |
| | Solvent (e) | 0.26 cc/m$^2$ |
| 3rd Layer (green-sensitive layer) | Silver halide emulsion (5) (silver bromide: 80 mol %) | 0.15 g/m$^2$ (in terms of silver) |
| | Gelatin | 1.80 g/m$^2$ |
| | Magenta coupler (f) | 0.38 g/m$^2$ |
| | Dye stabilizer (g) | 0.16 g/m$^2$ |
| | Solvent (h) | 0.38 cc/m$^2$ |
| 2nd Layer (color stain inhibiting layer) | Gelatin | 0.99 g/m$^2$ |
| | Color stain inhibitor (d) | 0.08 g/m$^2$ |
| | Solvent (e) | 0.26 cc/m$^2$ |
| 1st Layer (blue-sensitive layer | Silver halide emulsion (1) (silver bromide: 80 mol %) | 0.27 g/m$^2$ (in terms of silver) |
| | Gelatin | 1.86 g/m$^2$ |
| | Yellow coupler (a) | 0.62 g/m$^2$ |
| | Dye stabilizer (b) | 0.19 g/m$^2$ |
| | Solvent (c) | 0.34 cc/m$^2$ |
| Support | Polyethylene-laminated paper (containing a white pigment ($TiO_2$) and a blue dye (marine blue) in the 1st layer side polyethylene) | |

Specimens B, C and D were prepared in the same manner as in Specimen A except that the silver halide emulsion in the 1st layer was replaced by the silver halide emulsions 2, 3 and 4, respectively. Furthermore, specimens were prepared in the same manner as in Specimens A, B, C and D except that various dyes shown in Table 3 were added to the 1st layer of Specimens A, B, C and D, respectively.

The added amount of the dyes were such that the sensitivity of the blue-sensitive layers became substantially the same in the case of yellow dye, the sensitivity of the green-sensitive layers became substantially the same in the case of magenta dye, and the sensitivity of the red-sensitive layers became substantially the same in the case of cyan dye.

The specimens shown in Table 3 were subjected to gradation exposure for sensitometry through blue, green and red filters by means of a sensitometry (Fuji Photo Film Co., Ltd., Type FWH Sensitometry; color temperature of light source: 3,200° K.). In the exposure process, an exposure of 250 CMS was obtained for 10 seconds.

After being exposed, these specimens were subjected to color development, blix and washing. The temperature and time for these steps are shown below.

| Processing step | Temperature | Time |
|---|---|---|
| Color development (Processing A) | 33° C. | 3 min. 30 sec. |
| Blix (Processing A) | 33° C. | 1 min. 30 sec. |
| Washing | 28-35° C. | 3 min. |

-continued

| Coloring developing solution (Processing A) | |
|---|---|
| Water | 800 cc |
| Pentasodium diethylenetriamine-pentaacetate | 2.0 g |
| Benzyl alcohol | 15 cc |
| Diethylene glycol | 10 cc |
| Sodium sulfite | 2.0 g |
| Potassium bromide | 0.5 g |
| Hydroxylamine sulfate | 3.0 g |
| N-Ethyl-N-(β-methanesulfonamidoethyl)-3-methyl-4-aminoaniline sulfate | 5.0 g |
| Sodium carbonate (monohydrate) | 30.0 g |
| 4,4'-diaminostilben fluorescent brightening agent (Whitex 4, produced by Sumitomo Chemical Co., Ltd.) | 1.0 g |
| Water to make | 1,000 cc |
| pH | 10.1 |
| Blix solution (Processing A) | |
| Water | 700 cc |
| Ammonium thiosulfate (54 wt %) | 150 cc |
| Sodium sulfite | 15 g |
| $NH_4$[Fe(III)(EDTA)] | 55 g |
| EDTA.2Na (dihydrate) | 4 g |
| Water to make | 1,000 cc |
| pH | 6.9 |

The results of the relative sensitivity obtained by exposure at 25° C. and 55% RH and the desensitivity obtained by exposure at 25° C. and 85% RH with respect to the 25° C.-55% RH exposure are shown in Table 3. The term "relative sensitivity" as used herein means the relative value of the reciprocal of the exposure at a density of 0.5 plus the minimum density with respect to the value obtained without dye as 100. The term "desensitivity" as used herein means the difference in the relative sensitivity between the 25° C.-55 % RH exposure.

Table 3 only shows the results of the blue-sensitive layer which showed the biggest effect in order to give easy understanding.

As shown in Table 3, the specimens comprising the dyes of the present invention showed a less drop in the relative sensitivity and a less desensitivity at the 25° C.-85% RH exposure (less dependence on moisture at exposure). The greater the K value of the particulate silver halide is, the more remarkable is this difference. If the color balance is adjusted under the condition of the 25° C.-55% RH exposure, the present specimens showed a less change in color balance, exhibiting an excellent color reproduction, while the specimens comprising the comparative dyes colored bluish, exhibiting a great change in color balance.

Taking, for example, the difference in the K value of the silver halide emulsion, the specimens preferably have a smaller K value which causes a less drop in the relative sensitivity and a slightly small desensitivity. The comparison of spectral sensitivity and fresh preservability shown in Table 4 shows that the silver halide emulsions having the K values defined herein show better results. A comprehensive comparison shows that the combination of a silver halide emulsion and a dye defined herein shows excellent results.

The spectral sensitivity is represented by the relative sensitivity at the exposure to monochromatic light of 470 nm. The fresh preservability is represented by the relative sensitivity at the exposure to monochromatic light of 470 nm after aging for 2 days at 50° C. and 80% relative humidity.

TABLE 3

| No. | Dye | Added amount (mol/m²) | Layer | Specimen (A) Relative sensitivity | (A) Desensitivity | (B) Relative sensitivity | (B) Desensitivity | (C) Relative sensitivity | (C) Desensitivity | (D) Relative sensitivity | (D) Desensitivity |
|---|---|---|---|---|---|---|---|---|---|---|---|
| | | | | K value | | | | | | | |
| | | | B** | ∞ (Emulsion 1) | | 6.4 (Emulsion 2) | | 2.1 (Emulsion 3) | | 0.3 (Emulsion 4) | |
| | | | G** | ∞ (Emulsion 5) | | ∞ (Emulsion 5) | | ∞ (Emulsion 5) | | ∞ (Emulsion 5) | |
| | | | R** | ∞ (Emulsion 6) | | ∞ (Emulsion 6) | | ∞ (Emulsion 6) | | ∞ (Emulsion 6) | |
| 1 | T-1 (comparative) | $2.0 \times 10^{-5}$ | B | 42 | 35 | 45 | 31 | 52 | 24 | 56 | 19 |
| 2 | Example-2 | $2.0 \times 10^{-5}$ | B | 56* | 13* | 56* | 12* | 54 | 12 | 55 | 11 |
| 3 | T-2 (comparative) | $2.0 \times 10^{-5}$ | B | 42 | 34 | 50 | 31 | 66 | 28 | 89 | 20 |
| 4 | Example-12 | $3.0 \times 10^{-5}$ | B | 91* | 9* | 92* | 8* | 92 | 8 | 93 | 8 |
| 5 | Example-17 | $4.0 \times 10^{-5}$ | B | 93* | 13* | 93* | 12* | 95 | 11 | 94 | 11 |
| 6 | T-3 (comparative) | $2.0 \times 10^{-5}$ | B | 26 | 40 | 30 | 37 | 55 | 28 | 60 | 23 |
| 7 | T-4 (comparative) | $2.0 \times 10^{-5}$ | B | 15 | 31 | 18 | 32 | 40 | 24 | 58 | 20 |
| 8 | Example-33 | $2.0 \times 10^{-5}$ | B | 63* | 21* | 63* | 21* | 65 | 18 | 63 | 16 |
| 9 | Example-35 | $4.0 \times 10^{-5}$ | B | 71* | 9* | 74* | 9* | 72 | 8 | 73 | 9 |
| 10 | Example-38 | $2.0 \times 10^{-5}$ | B | 79* | 22* | 81* | 21* | 81 | 19 | 83 | 17 |
| 11 | Example-41 | $2.0 \times 10^{-5}$ | B | 75* | 19* | 76* | 18* | 77 | 16 | 79 | 15 |
| 12 | None (comparative) | — | B | 100 | 24 | 100 | 24 | 100 | 21 | 100 | 17 |

*the combination of the present invention
**B: blue-sensitive layer
G: green-sensitive layer
R: red-sensitive layer

T-1

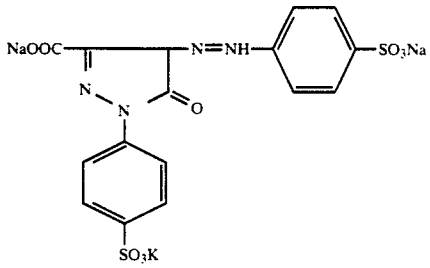

T-2

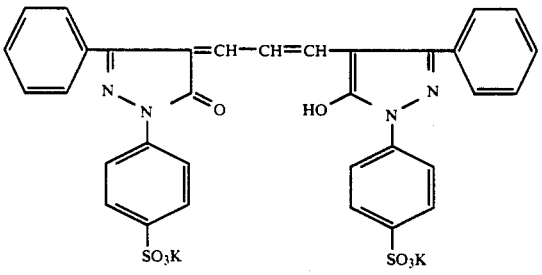

T-3

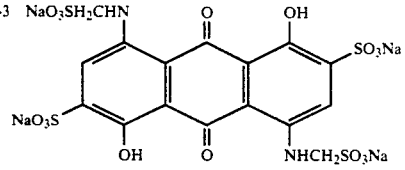

T-4

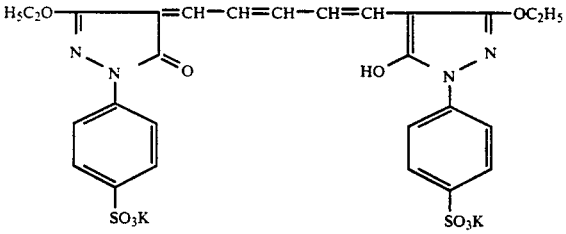

TABLE 4

| | No. | K value (B) | Specimen A ∞ | B 6.4 | C 2.1 | D 0.3 |
|---|---|---|---|---|---|---|
| Spectral Sensitivity | 2 | | 204 | 174 | 112 | 100 |
| | 4 | | 200 | 178 | 110 | 100 |
| | 5 | | 209 | 182 | 115 | 100 |
| | 8 | | 195 | 174 | 112 | 100 |
| | 9 | | 200 | 178 | 112 | 100 |
| | 10 | | 204 | 178 | 110 | 100 |
| | 11 | | 200 | 174 | 115 | 100 |
| Fresh Preservability | 2 | | 190 | 155 | 77 | 56 |
| | 4 | | 191 | 162 | 76 | 59 |
| | 5 | | 195 | 162 | 83 | 56 |
| | 8 | | 186 | 155 | 77 | 59 |
| | 9 | | 191 | 162 | 77 | 56 |
| | 10 | | 190 | 158 | 80 | 56 |
| | 11 | | 191 | 152 | 80 | 55 |

(The specimens in Table 4 correspond to those shown in Table 3. The values are determined with respect to that of Specimen D as 100.)

EXAMPLE 2

A silver halide emulsion (7) for a blue-sensitive silver halide emulsion layer was prepared as follows:

| | |
|---|---|
| Solution 8 | |
| $H_2O$ | 1,000 cc |
| NaCl | 5.8 g |
| Gelatin | 25 g |
| Solution 9 | |
| Sulfuric acid (1N) | 20 cc |
| Solution 10 | |
| Silver halide solvent having the following formula (1%) | 3 cc |

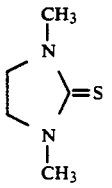

Solution 11

-continued

| | |
|---|---|
| KBr | 0.18 g |
| NaCl | 8.51 g |
| $H_2O$ to make | 130 cc |
| Solution 12 | |
| $AgNO_3$ | 25 g |
| $H_2O$ to make | 130 cc |
| Solution 13 | |
| $Pb(CH_3COO)_2$ (trihydrate) (0.1%) | 28 cc |
| Solution 14 | |
| KBr | 0.70 g |
| NaCl | 34.05 g |
| $H_2O$ to make | 285 cc |
| Solution 15 | |
| $AgNO_3$ | 100 g |
| $H_2O$ to make | 285 cc |

Solution 8 was heated to a temperature of 60° C. Solution 9 and Solution 10 were then added to Solution 8 thus heated. Solution 11 and Solution 12 were added to the admixture at the same time in 60 minutes. After 1 minute passed, Solution 13 was added to the admixture. After 9 minutes passed, Solution 14 and Solution 15 were added to the admixture at the same tie in 25 minutes. After 5 minutes passed, the admixture was allowed to cool, and desalted. Water and a dispersion of gelatin were added to the admixture. The pH of the admixture was then adjusted to 6.0 to obtain a monodisperse cubic silver chlorobromide emulsion having an average particle size of 1.0 μm and a fluctuation coefficient of 0.11 and containing 1 mol % of silver bromide. Triethylthiourea and chloroauric acid were added to the emulsion thus prepared so that the optimum chemical sensitization was effected. The spectral sensitizer (l) below was added to the emulsion in an amount of $7\times10^{-4}$ mol per 1 mol of silver halide emulsion.

A silver halide emulsion 8 for a green-sensitive silver halide emulsion layer and a silver halide emulsion 9 for a red-sensitive silver halide emulsion layer were prepared in the same manner as described above except in that the amount of the chemicals used in Solutions 8 and 10, the type and amount of the spectral sensitizers, the temperature at which these compounds are added, and the time required for the addition of these compounds were changed. The spectral sensitizer used for the silver halide emulsion 8 has the formula (m) below. The spectral sensitizer used for the silver halide emulsion 9 has the undermentioned general formula (n).

(l)

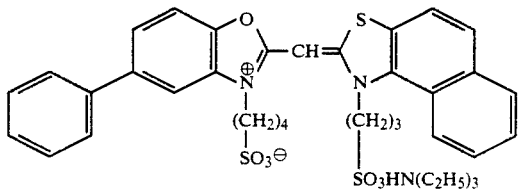

(Added amount: $7\times10^{-4}$ mol per mol of silver halide)

(m)

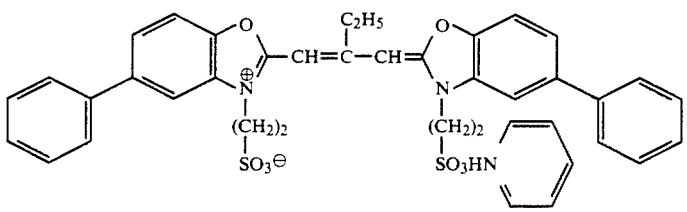

(Added amount: $4\times10^{-4}$ mol per mol of silver halide)

(n)

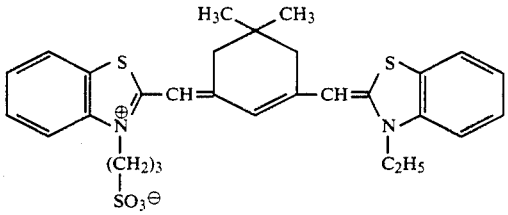

(Added amount: $2\times10^{-4}$ mol per mol of silver halide)

The average particle size, deviation coefficient, halogen composition, and K value of the silver halide emulsions 7 to 9 are shown in Table 5.

Specimen E was prepared in the same manner as Specimen A in Example 1 except in that the silver halide emulsions for the 1st, 3rd and 5th layers were replaced by the silver halide emulsions 7, 8 and 9, respectively. Furthermore, specimens were prepared by adding the dyes shown in Table 6 to Specimen E.

TABLE 5

| Emulsion | Average particle size (μm) | Deviation coefficient (s/d) | Halogen Composition Br % | Cl % | K value |
|---|---|---|---|---|---|
| 7 | 1.00 | 0.09 | 1.0 | 99.0 | ∞ |
| 8 | 0.44 | 0.10 | 0.4 | 99.6 | ∞ |
| 9 | 0.53 | 0.09 | 1.0 | 99.0 | ∞ |

TABLE 6

| No. | Dye | Added amount (mol/m²) | Specimen E Layer | Relative sensitivity | Desensitivity | Sharpness (%) |
|---|---|---|---|---|---|---|
| 1 | T-2 | $1.4 \times 10^{-5}$ | Blue | 42 | 48 | 22.1 |
| | T-4 | $2.0 \times 10^{-5}$ | Green | 35 | 38 | 28.3 |
| | (comparative) | | Red | 39 | 38 | 30.3 |
| 2 | Example 12 | $2.1 \times 10^{-5}$ | Blue | 73 | 29 | 22.4 |
| | Example 33 | $2.0 \times 10^{-5}$ | Green | 40 | 28 | 31.5 |
| | (present invention) | | Red | 42 | 20 | 32.2 |
| 3 | Example 17 | $2.8 \times 10^{-5}$ | Blue | 76 | 35 | 22.4 |
| | Example 38 | $2.0 \times 10^{-5}$ | Green | 45 | 30 | 30.0 |
| | (present invention) | | Red | 45 | 23 | 31.8 |
| 4 | None | — | Blue | 100 | 37 | 20.9 |
| | (comparative) | | Green | 100 | 32 | 26.4 |
| | | | Red | 100 | 29 | 24.8 |

The specimens shown in Table 6 were subjected to gradation exposure in the same manner as in Example 1.

After being exposed to light, these specimens were subjected to processing consisting of color development, blix, and rinse. The temperature and time for these steps are shown hereinafter.

| Processing step | Temperature | Time |
|---|---|---|
| Color development (Processing B) | 35° C. | 45 sec. |
| Blix (Processing B) | 35° C. | 45 sec. |
| Rinse | 28–35° C. | 1 min. 30 sec. |

| | |
|---|---|
| Color developing solution (Processing B) | |
| Water | 800 cc |
| Pentasodium diethylenetriamine-pentaacetate | 1.0 g |
| Sodium sulfite | 0.2 g |
| N,N-Diethylenehydroxylamine | 4.2 g |
| Potassium bromide | 0.01 g |
| Sodium chloride | 1.5 g |
| Triethanolamine | 8.0 g |
| N-Ethyl-N-(β-methanesulfonamideethyl)-3-methyl-4-aminoaniline sulfate | 4.5 g |
| Potassium carbonate | 30.0 g |
| 4,4'-Diaminostilben fluorescent brightening agent (Whitex 4, produced by Sumitomo Chemical Co., Ltd.) | 2.0 g |
| Water to make | 1,000 cc |
| pH | 10.1 |
| Blix solution (Processing A) | |
| Water | 700 cc |
| Ammonium thiosulfate (54 wt %) | 150 cc |
| Sodium sulfite | 15 g |
| $NH_4$[Fe(III)(EDTA)] | 55 g |
| EDTA.2Na (dihydrate) | 4 g |
| Glacial acetic acid | 8.61 g |
| Water to make | 1,000 cc |
| pH | 5.4 |
| Rinse solution | |
| EDTA.2Na (dihydrate) | 0.4 g |
| Water to make | 1,000 cc |
| pH | 7.0 |

The results of the relative sensitivity, sensitivity, and sharpness defined in Example 1 are shown in Table 6.

The sharpness is an amount represented the clearness of the contours of the image and the ability to draw fine images. In the present invention, the sharpness is determined by CTF value. CTF represents the degree of attenuation of amplitude of square waveform with respect to space frequency. In Table 5, the sharpness is determined by values measured at a space frequency of 15 lines/mm. The greater this value is, the higher is the sharpness.

Table 6 shows that the present specimens show less change in the relative sensitivity of the blue-sensitive silver halide emulsion layer and higher sharpness, exhibiting excellent photographic properties, while the comparative specimens show a drop in the relative sensitivity of the blue-sensitive silver halide emulsion layer which should not be dropped and a great desensitivity. Furthermore, the present specimens show a smaller change in the color balance even upon exposure at a high humidity, giving an excellent color reproduction.

EXAMPLE 3

Specimens were prepared in the same manner as Specimen A in Example 1 except that the dyes shown in Table 4 were added to the 4th layer.

These specimens were subjected to exposure and development in the same manner as in Example 1. These specimens were then evaluated for the photographic properties in the same manner as in Example 1.

The evaluation shows similar results to that of Example 1. Table 7 shows that the present specimens show a smaller drop in the relative sensitivity of the light-sensitive layer which should not be affected and a smaller desensitivity upon exposure at a high humidity, providing excellent photographic properties. This effect is maintained even when the added amount of dye is increased. The present specimens also show a high sharpness, giving an excellent color reproduction.

TABLE 7

| No. | Dye | Added amount (mol/m²) | Specimen A Layer | Relative sensitivity | Desensitivity | Sharpness (%) |
|---|---|---|---|---|---|---|
| 1 | T-4 | $2.0 \times 10^{-5}$ | Blue | 75 | 28 | 22.3 |
| | (comparative) | | Green | 71 | 20 | 27.4 |
| | | | Red | 40 | 20 | 31.1 |
| 2 | T-4 | $5.0 \times 10^{-5}$ | Blue | 58 | 30 | 22.2 |
| | (comparative) | | Green | 28 | 25 | 27.6 |
| | | | Red | 16 | 22 | 33.3 |
| 3 | Example 33 | $2.0 \times 10^{-5}$ | Blue | 95 | 18 | 22.4 |

TABLE 7-continued

| No. | Dye | Added amount ($mol/m^2$) | Specimen A Layer | Relative sensitivity | Desensitivity | Sharpness (%) |
|---|---|---|---|---|---|---|
| | (present | | Green | 74 | 16 | 27.5 |
| | invention) | | Red | 42 | 13 | 33.0 |
| 4 | Example 33 | $5.0 \times 10^{-5}$ | Blue | 90 | 19 | 22.4 |
| | (present | | Green | 32 | 17 | 27.4 |
| | invention) | | Red | 25 | 13 | 34.5 |
| 5 | T-2 | $1.4 \times 10^{-5}$ | Blue | 71 | 35 | 23.0 |
| | T-4 | $2.0 \times 10^{-5}$ | Green | 50 | 28 | 29.0 |
| | (comparative) | | Red | 38 | 22 | 31.0 |
| 6 | Example 12 | $2.1 \times 10^{-5}$ | Blue | 79 | 19 | 23.2 |
| | Example 33 | $2.0 \times 10^{-5}$ | Green | 58 | 16 | 31.4 |
| | (present | | Red | 41 | 14 | 34.5 |
| | invention) | | | | | |
| 7 | T-1 | $2.0 \times 10^{-5}$ | Blue | 38 | 38 | 24.3 |
| | T-2 | $1.4 \times 10^{-5}$ | Green | 43 | 33 | 29.3 |
| | T-3 | $2.5 \times 10^{-5}$ | Red | 45 | 26 | 30.3 |
| | (comparative) | | | | | |
| 8 | Example 2 | $2.0 \times 10^{-5}$ | Blue | 50 | 18 | 25.5 |
| | Example 12 | $2.1 \times 10^{-5}$ | Green | 55 | 16 | 31.4 |
| | Example 37 | $2.0 \times 10^{-5}$ | Red | 43 | 14 | 34.4 |
| | (present | | | | | |
| | invention) | | | | | |
| 9 | None | — | Blue | 100 | 24 | 22.0 |
| | (comparative) | | Green | 100 | 17 | 27.2 |
| | | | Red | 100 | 15 | 26.3 |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material which comprises a support having provided thereon at least one spectrally sensitized silver halide emulsion layer wherein silver halide grains comprise monodisperse silver chlorobromide containing at least 2 mol % of silver chloride and having an area ratio of crystal face of a Mirror indeces (100 ) satisfying the relationship:

$$5.0 \leqq zK \leqq \infty$$

wherein K represents the ratio of the intensity of diffracted rays attributable to (200) face to that of diffracted rays attributable to (222) face determined by X-ray diffraction analytical method, represented by:

$$K = \frac{\text{Intensity of diffracted rays attributable to 200 face)}}{\text{Intensity of diffracted rays attributable to (222) face)}}$$

and wherein said silver halide color photographic material contains at least one dye represented by the formula (II)

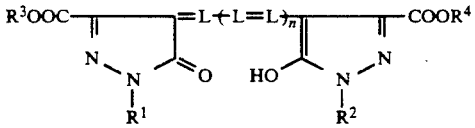

wherein n represents 0, 1 or 2, $R^1$ and $R^2$ each represents an aryl group selected from the group consisting of a 4-(3-sulfopropylcarbamoyl)phenyl group, a 2,4-disulfophenyl group, a 3,5-dicarboxylphenyl group, and a 3-(3-sulfopropylamino)-phenyl group, a 3,5-dicarboxylphenyl group, and a 3-carboxy-5-sulfophenyl group; $R^3$ and $R^4$ each represents a hydrogen atom, a substituted or unsubstituted alkyl group or a substituted or unsubstituted aryl group when n represents 0 or 1, or a hydrogen atom, a substituted alkyl group containing at least one sulfonic acid group or carboxylic acid group or a substituted aryl group containing at least one sulfonic acid group or carboxylic acid group when n represents 2; and L represents a substituted or unsubstituted methine group, and any two or more of the substituents on L may be linked together to form a ring.

2. A silver halide color photographic material as claimed in claim 1, wherein said silver halide grains comprises a monodisperse silver chlorobromide containing at least 90 mol % of silver chloride.

3. A silver halide color photographic material as claimed in claim 1, wherein said dye is coated in an amount of from $1 \times 10^{-6}$ to $2 \times 10^{-3}$ $mol/m^2$ of the silver halide color photographic material.

4. A silver halide color photographic material as claimed in claim 1, wherein said silver halide grains have a K value satisfying the relationship:

$$10.0 \leqq K \leqq \infty$$

wherein K is as defined in claim 1.

5. A silver halide color photographic material as claimed in claim 1, wherein said silver halide grains have a K value satisfying the relationship:

$$20.0 \leqq K \leqq \infty$$

wherein K is as defined in claim 1.

6. A silver halide color photographic material as claimed in claim 1, wherein said silver halide grains have an average grain size of from 0.2 μm to 1.3 μm.

7. A silver halide color photographic material as claimed in claim 1, wherein said silver halide grains have a particle size distribution of 0.2 or less in terms of the ratio ($S/\bar{d}$) wherein S represents a statistical standard deviation and d represents an average particle size.

8. A silver halide color photographic material as claimed in claim 1, wherein said particle size distribution is 0.15 or less.

* * * * *

UNITED STATES PATENT AND TRADEMARK OFFICE

CERTIFICATE OF CORRECTION

PATENT NO. : 5,147,770

DATED : September 15, 1992

INVENTOR(S) : Kokichi Waki and Shigeru Ohno

It is certified that error appears in the above-identified patent and that said Letters Patent is hereby corrected as shown below:

On the title page:

Please change Section [21] to read --Appln. No. 814,958--.

Signed and Sealed this

Twelfth Day of October, 1993

*Attest:*

Bruce Lehman

BRUCE LEHMAN

*Attesting Officer*

*Commissioner of Patents and Trademarks*